US010854996B2

(12) United States Patent
Boutayeb et al.

(10) Patent No.: US 10,854,996 B2
(45) Date of Patent: Dec. 1, 2020

(54) DUAL-POLARIZED SUBSTRATE-INTEGRATED BEAM STEERING ANTENNA

(71) Applicant: HUAWEI TECHNOLOGIES CO., LTD., Shenzhen, Guangdong (CN)

(72) Inventors: Halim Boutayeb, Kanata (CA); Fayez Hyjazie, Ottawa (CA); Wen Tong, Ottawa (CA)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 16/294,404

(22) Filed: Mar. 6, 2019

(65) Prior Publication Data

US 2020/0287297 A1 Sep. 10, 2020

(51) Int. Cl.
*H01Q 21/24* (2006.01)
*H01Q 1/36* (2006.01)
(Continued)

(52) U.S. Cl.
CPC ..... *H01Q 21/24* (2013.01); *H01Q 1/246* (2013.01); *H01Q 1/36* (2013.01); *H01Q 1/50* (2013.01); *H01Q 21/061* (2013.01)

(58) Field of Classification Search
CPC ..... H01Q 21/06; H01Q 21/061; H01Q 21/24; H01Q 1/36; H01Q 1/50
See application file for complete search history.

(56) References Cited

U.S. PATENT DOCUMENTS 9,397,395 B2 7/2016 Boutayeb
9,490,535 B2 11/2016 Boutayeb et al.
(Continued)

FOREIGN PATENT DOCUMENTS

CN 108493628 A 9/2018
CN 109066065 A 12/2018
WO 2009116934 A1 9/2009

OTHER PUBLICATIONS

Boutayeb, Halim et al. 28GHz Dual Polarized Beam Steering Antenna with Substrate Integrated Frequency Selective Structure, 2019 13th European Conference on Antennas and Propagation (EuCAP) Jun. 20, 2019, total 5 pages.
(Continued)

*Primary Examiner* — Jason Crawford
(74) *Attorney, Agent, or Firm* — BCF LLP

(57) ABSTRACT

The disclosed structures and methods are directed to transmission and reception of a radio-frequency (RF) wave. An antenna comprises a stack-up structure having a first control layer, a second control layer, a first and a second parallel-plate waveguides, and a plurality of through vias. The antenna further comprises a first central port and a second central port being configured to radiate RF wave into the two parallel-plate waveguides independently; vertical-polarization peripheral radiating elements integrated with the first control layer and configured to radiate RF wave in vertical polarization; and horizontal-polarization peripheral radiating elements integrated with the second control layer and configured to radiate RF wave in horizontal polarization. Each vertical-polarization peripheral radiating element is collocated with one of the horizontal-polarization peripheral radiating element such that they cross each other. A central port for transmission of RF wave into the stack-up structure of the antenna is also provided.

16 Claims, 29 Drawing Sheets

(51) Int. Cl.

| | |
|---|---|
| ***H01Q 1/24*** | (2006.01) |
| ***H01Q 1/50*** | (2006.01) |
| *H01Q 21/06* | (2006.01) |

(56) References Cited

U.S. PATENT DOCUMENTS

| | | | | |
|---|---|---|---|---|
| 9,502,765 | B2 | 11/2016 | Boutayeb et al. | |
| 10,424,847 | B2 * | 9/2019 | Isom | H01Q 15/0026 |
| 10,468,780 | B1 * | 11/2019 | Milroy | H01Q 1/42 |
| 2004/0027291 | A1 * | 2/2004 | Zhang | H01Q 19/10 343/700 MS |
| 2009/0073075 | A1 * | 3/2009 | Irion, II | H01Q 21/24 343/859 |
| 2010/0245204 | A1 | 9/2010 | Lee et al. | |
| 2012/0146869 | A1 * | 6/2012 | Holland | H01Q 21/061 343/795 |
| 2016/0079672 | A1 * | 3/2016 | Cerreno | H01Q 21/065 343/848 |
| 2018/0040955 | A1 * | 2/2018 | Vouvakis | H01Q 5/42 |

OTHER PUBLICATIONS

Boutayeb, Halim et al. Beam Switching Dual Polarized Antenna Array With Reconfigurable Radial Waveguide Power Dividers, IEEE Transactions on Antennas and Propagation, vol. 65, No. 4, Apr. 2017. pp. 1807-1814.

Boutayeb, Halim et al. New Recontigurable Power Divider Based on Radial Waveguide and Cylindrical Electromagnetic Band Gap Structure for Low Power and Low Cost Smart Antenna Systems, IEEE AP-S 2014. pp. 1457-1458.

Xu, Jun et al. A Q-Band Low-Profile Dual Circularly Polarized Array Antenna Incorporating Linearly Polarized Substrate Integrated Waveguide-Fed Patch Subarrays IEEE Transactions on Antennas and Propagation Oct. 31, 2017.

International Search Report and Written Opinion of PCT/CN2020/077762; Yongxu Xue; dated May 29, 2020.

* cited by examiner

DUAL-POLARIZED SUBSTRATE-INTEGRATED BEAM STEERING ANTENNA

FIELD OF THE INVENTION

The present invention generally relates to the field of wireless communications and, in particular, to antenna systems configured to transmit and receive a wireless signal to and from different directions.

BACKGROUND

Antenna systems having wide steering angles and high directivity are sought after in wireless communications applications. Planar phased array antennas do provide the capability of wide steering angles, but the directivity of such antennas has a tendency to decrease with increases in the steering angle of the directed beam. Planar phased array antennas may also have blind angular regions and are expensive due to fabrication processes and the costs associated with phase shifters.

SUMMARY

An object of the present disclosure is to provide a dual-polarized substrate-integrated beam steering antenna for transmission and reception of a radio-frequency (RF) wave. The antenna is configured to transmit and receive a wireless signal in and from different directions.

In accordance with this objective, an aspect of the present disclosure provides an antenna for transmission of a radio-frequency (RF) wave. The antenna comprises a stack-up structure having: a first control circuit layer (also referred to herein as a "first control layer"); a second control circuit layer (also referred to herein as a "second control layer") being approximately parallel to the first control circuit layer; a first parallel-plate waveguide and a second parallel-plate waveguide located between the first control layer and the second control layer; a plurality of through vias operatively connecting the first control layer and the second control layer to center RF and DC ground planes. The first parallel-plate waveguide and the second parallel-plate waveguide are approximately parallel to each other and to the first control layer and the second control layer. The antenna also comprises a first central port located on the first control layer and a second central port located on the second control layer, the first central port being configured to radiate the RF wave into the first parallel-plate waveguide, and the second central port being configured to radiate the RF wave into the second parallel-plate waveguide. The antenna also comprises vertical-polarization peripheral ports integrated with first control circuit layer and configured to radiate RF wave in vertical polarization from the first parallel-plate waveguide structure; and horizontal-polarization peripheral ports integrated with the second control circuit layer and configured to radiate RF wave in horizontal polarization from the second parallel-plate waveguide structure, each one of the vertical-polarization peripheral ports being collocated with one of the horizontal-polarization peripheral ports such that they cross each other.

In at least one embodiment, each one of the vertical-polarization peripheral ports comprises: two inductance lines, located on the first control circuit layer, and a monopole comprising: four vias of the monopole operating as a radiating part of the monopole, a monopole microstrip operatively connecting the four vias of the monopole on the first control circuit layer, and a block line operatively connecting two of the four vias of the monopole. In at least one embodiment, each one of the horizontal-polarization peripheral ports comprises: a dipole having a first branch and a second branch, the dipole being located approximately perpendicular to the four vias of the monopole, a central portion of the dipole being located between the four vias of the monopole.

A distance between the first control circuit layer and the second control circuit layer may be configured to accommodate the monopole and may be approximately a quarter of a quarter wavelength in free space.

The first branch and the second branch of the dipole may be located in different planes.

The antenna may further comprise a pair of frequency selective structures having frequency selective elements, each frequency selective structure being located on a corresponding one of the first control circuit layer and second control circuit layer, each frequency selective element being configured: to allow propagation of the RF wave in one of the first parallel-plate waveguide and the second parallel-plate waveguide when the frequency selective element is in one operational mode and to forbid propagation of the RF wave in one of the first parallel-plate waveguide and the second parallel-plate waveguide when the frequency selective element is in another operational mode.

In at least one embodiment, each frequency selective element comprises: a radial stub configured to choke high frequencies while passing low frequencies when the current received by the radial stub is higher than a threshold; and a switchable element operatively connected to the radial stub and one of the first parallel-plate waveguide and the second parallel-plate waveguide by one of the plurality of through vias, the switchable element configured to selectively control the operational mode of the frequency selective element.

In at least one embodiment, the antenna may be configured to steer a radiation angle of the RF wave by selectively switching between one and the other operational mode of the frequency selective elements and by selectively switching ON a first plurality of frequency selective elements and switching OFF a second plurality of frequency selective elements.

Each switchable element may further comprise a connector stub, the connector stub configured to operatively connect the switchable element to the one of the plurality of through vias. The connector stub may have a pair of stub arms, each stub arm being operatively connected to the via and to the switchable element.

In at least one embodiment, the frequency-selective elements of at least one frequency-selective structure of the pair of frequency-selective structures may be arranged in rows and each frequency selective element in each row may be located at approximately equal distance from the central port located on the same surface as the at least one frequency-selective structure of the pair of frequency selective structures.

The switchable element may further comprise a connector stub, the connector stub configured to operatively connect the switchable element to the one of the plurality of through vias. At least one of rows of frequency selective elements may have frequency selective elements with connector stubs being shorter than connector stubs of frequency selective elements of the other rows.

The distance between the rows may be approximately equal to $2*\lambda_g$, where $\lambda_g$ is the wavelength of the RF wave inside the corresponding one of the first parallel-plate waveguide and the second parallel-plate waveguide.

At least two of the frequency selective elements may be operatively connected to one direct current circuit and may be operated simultaneously.

In at least one embodiment, at least one of the first central port and the second central port may comprise: a central microstrip operatively connected to one central via traversing the corresponding one of the first parallel-plate waveguide and the second parallel-plate waveguide, the central via being connected to an electrical ground; a pair of shoulders, both shoulders being operatively connected to a feed, the feed being operatively connected to an RF controller and being configured to deliver RF energy to the pair of shoulders; and a plurality of sub-shoulders, each sub-shoulder being operatively connected to one of the pair of shoulders on one end and to the central microstrip on the other end, a distance between two neighboring sub-shoulders of the plurality of sub-shoulders at their respective connection points with the central microstrip being approximately the same for each pair of neighboring sub-shoulders of the plurality of sub-shoulders.

The antenna may be one of a plurality of antennas, and frequency selective elements of the plurality of antennas may be configured to operate simultaneously and be selectively switched ON and OFF. The antenna may be further configured to steer a radiation angle of the RF wave, the steering being provided by selectively switching on a first plurality of frequency selective elements of the plurality of antennas and switching off the second plurality of frequency selective elements of the plurality of antennas. The plurality of antennas may comprise protective layers located between neighboring antennas.

In accordance with additional aspects of the present disclosure, there is provided a central port for transmission of the RF wave into one parallel-plate waveguide of an antenna. The central port comprises: a central microstrip operatively connected to one central via traversing one parallel-plate waveguide, the central via being connected to an electrical ground; a pair of shoulders, both shoulders being operatively connected to a feed, the feed being operatively connected to an RF transceiver and being configured to deliver or receive RF energy to/from the pair of shoulders; and a plurality of sub-shoulders, each sub-shoulder being operatively connected to one of the pair of shoulders on one end and to the central microstrip on the other end, a distance between two neighboring sub-shoulders of the plurality of sub-shoulders at their respective connection points with the central microstrip being approximately the same for each pair of neighboring sub-shoulders of the plurality of sub-shoulders.

In at least one embodiment, the plurality of sub-shoulders is configured to deliver or receive RF energy to/from the central microstrip symmetrically with regards to the central via. The plurality of sub-shoulders may be four sub-shoulders. The central microstrip may have a symmetric shape and the central microstrip may be operatively connected to the central via in the middle of the central microstrip. The central microstrip may have a shape of a cross.

In accordance with other aspects of the present disclosure, there is provided an antenna structure for evaluating performance of a central port for an antenna for transmission of a radio-frequency (RF) wave, the antenna structure comprising: a horn-shape waveguide; a central port integrated with the horn-shape waveguide and configured to generate an RF wave into horn-shape waveguide; a plurality of output microstrips distributed radially around the central port. The power divider may also comprise a plurality of slots for the transitions between the horn-shape waveguide and the output microstrips lines. The power divider may also comprise a metallic wall integrated with the horn-shape waveguide partially surrounding the central port and configured to confine the RF wave, generated by the central port, within an area defined by the metallic wall, while the RF wave propagates from the central port towards the output microstrips. The output microstrips may be operatively connected to peripheral ports distributed radially around the central port and configured to radiate or receive the RF wave from/to the horn-shape waveguide.

The RF wave may be radiated in a millimeter wave range and bellow (10 GHz to 300 GHz). The switchable element may be a PIN diode. In at least one embodiment, each frequency selective element located on the second control circuit layer is connected to a corresponding frequency selective element, located on the first control circuit layer, by the through via.

BRIEF DESCRIPTION OF THE FIGURES

The features and advantages of the present disclosure will become apparent from the following detailed description, taken in combination with the appended drawings, in which.

Figure 1:
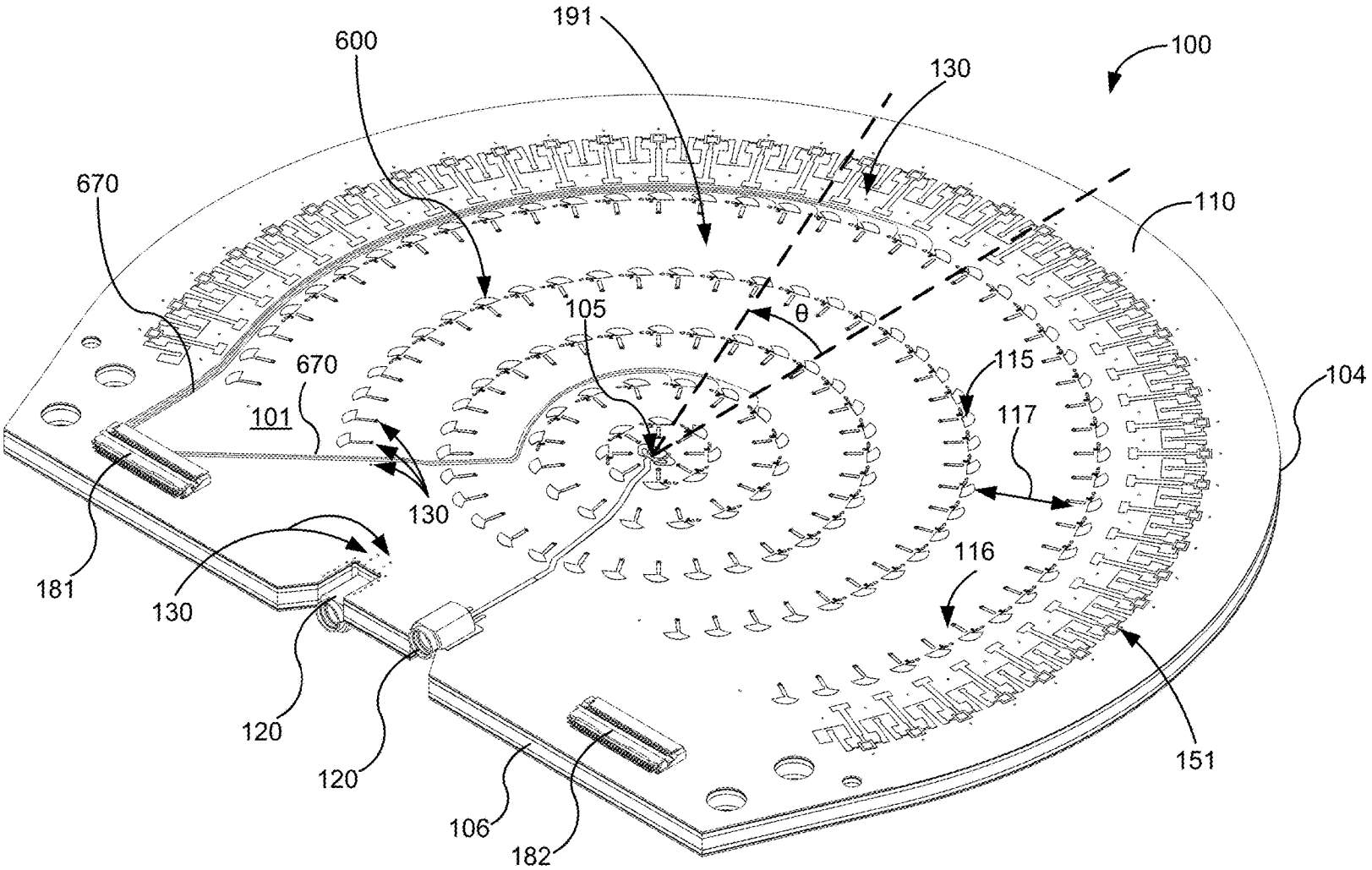
FIG. 1 depicts a perspective view of a beam steering antenna, in accordance with at least one non-limiting embodiment of the present technology, in accordance with various embodiments of the present disclosure.

It is to be understood that throughout the appended drawings and corresponding descriptions, like features are identified by like reference characters. Furthermore, it is also to be understood that the drawings and ensuing descriptions are intended for illustrative purposes only and that such disclosures are not intended to limit the scope of the claims.

DETAILED DESCRIPTION

The instant disclosure is directed to addressing the deficiencies of current phased array antennas implementations. The instant disclosure describes a beam steering antenna (also referred to herein as "antenna"), having two parallel-plate waveguides and two integrated frequency selective structures (FSSs). The antenna is configured to provide increased ranges of steering angles for both vertical and horizontal polarizations while also providing high directivity (of about 13 dB to 16 dB) with low variation (about 10%) for various steering angle ranges.

The technology described herein may be embodied in a variety of different electronic devices (EDs) including base stations (BSs), user equipment (UE), etc.

It will be appreciated that the electromagnetic (EM) wave that is one of propagated by and received by the disclosed antenna configuration may be within a radio frequency (RF) range (i.e., RF wave). In some embodiments, the RF wave may be a millimeter wave range and below (e.g., operating frequencies of about 10 GHz to about 300 GHz). In other embodiments, the RF wave may be in a microwave range (e.g., about 1 GHz to about 10 GHz).

The antenna structure as described herein may be configured to operate in a millimeter wave range and below (i.e., between 10 GHz and about 300 GHz). It should be understood, however, that the presented antenna structure may also operate at other RF range frequencies. Moreover, the antenna structure, as described herein may, in various embodiments, be formed from appropriate features of a multilayer printed circuit board (PCB). The features of the antenna structure may be formed by etching of conductive layers and manufacturing of vias along with other such conventional PCB manufacturing techniques. Such a PCB implementation may be suitably compact for inclusion in electronic devices such as BS and UEs. Mature manufacturing techniques known in the PCB field may be used to provide suitable cost-effective volume production.

As used herein, the term "about" or "approximately" refers to a +/−10% variation from the nominal value. It is to be understood that such a variation is always included in a given value provided herein, whether or not it is specifically referred to.

As referred to herein, the term "guided wavelength" refers to a wavelength of propagation of an EM wave to provide propagation of a transverse electromagnetic mode (TEM) inside a corresponding waveguide. In addition, as referred to herein, the term "via" refers to an electrical connection providing electrical connectivity between the physical layers of an electronic circuit.

Unless otherwise defined, all technical and scientific terms used herein have the same meaning as commonly understood by one of ordinary skill in the art to which the described embodiments appertain to.

In accordance with the contemplated embodiments of the instant disclosure, the antenna structure, as described herein, may be configured to steer the angle of RF beam transmission and reception by actuating a plurality of frequency selective elements (FSE) integrated with two parallel-plate waveguides. In particular, the antenna structure may be configured to switch and operate to an "ON" state based on a first plurality of FSEs and operate to switch to an "OFF" state based on a second plurality of FSEs.

Compared to conventional planar phased array antennas, the embodiments of the instantly disclosed antenna structure, may provide any or all of a wider steering angle range (e.g., at least 180 degrees and up to 360 degrees), while exhibiting lower losses and a lower power consumption. Furthermore, the disclosed antenna structure may be integrated with a substrate of a stacked-up arrangement that may be configured to operate in vertical and horizontal polarizations as well as radiate and receive multiple EM beams. In addition, as compared to the conventional planar phased array antennas, the disclosed antenna structure may be less expensive to manufacture in view of the implementation of switchable elements instead of phase shifters to steer the beam angle, and the use of a multilayer PCB process when fabricating the antenna.

Figure 2A:
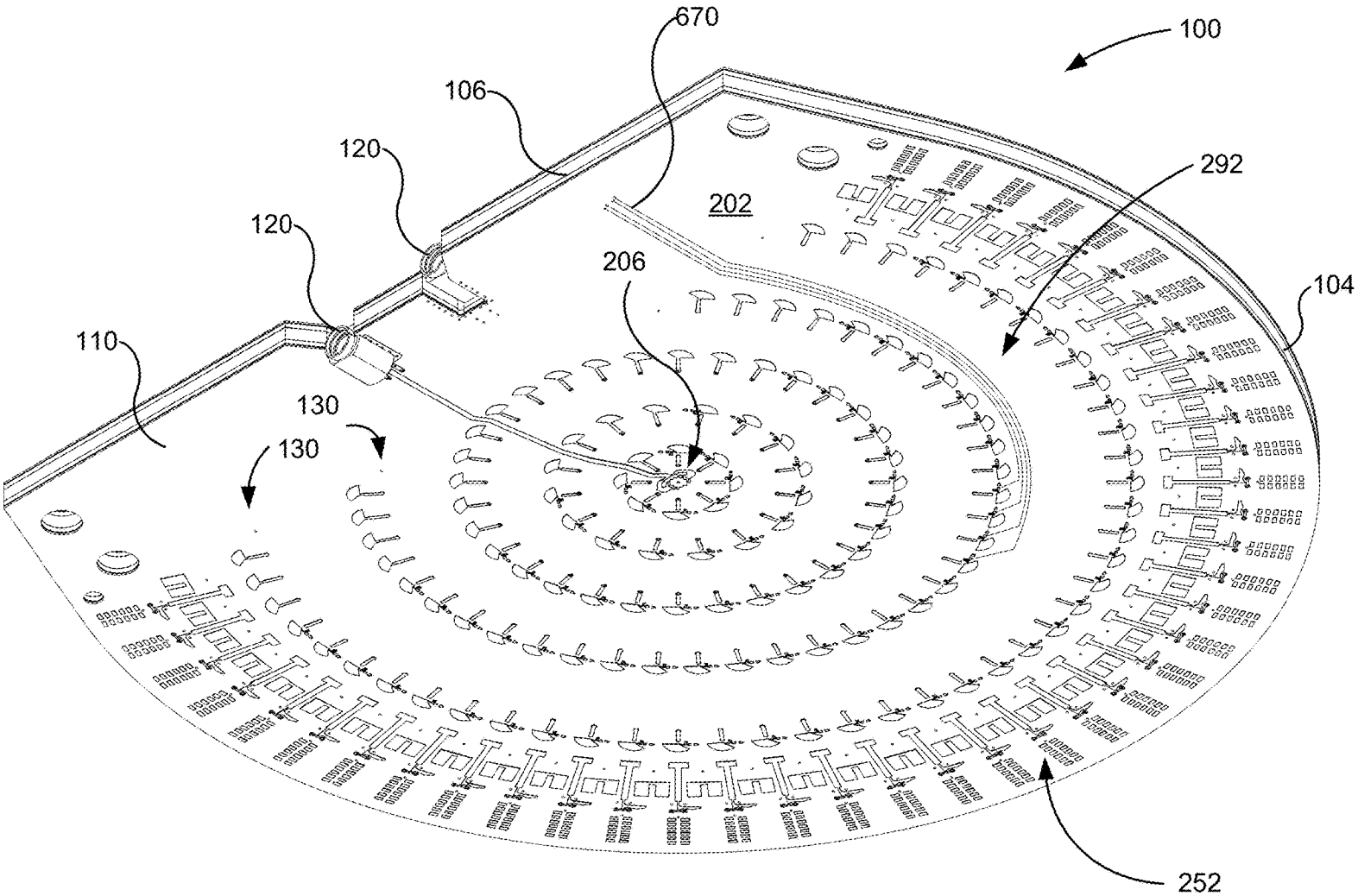
FIG. 2A depicts an underside perspective view of the antenna of FIG. 1, in accordance with at least one non-limiting embodiment of the present technology.

Referring now to drawings, FIG. 1 depicts a perspective top view of the structure of antenna 100, in accordance with the various embodiments of the present disclosure, and FIG. 2A depicts an underside (i.e., bottom) perspective view of antenna 100 of FIG. 1, in accordance with the various embodiments of the present disclosure.

As shown, antenna 100 comprises a stack-up structure 110 having two control layers: a first control layer 101 (referred to herein as "first control circuit layer") and a second control layer 202 (referred to herein as "second control circuit layer"). Antenna 100 further comprises central port 105 disposed on the top, central port 206 disposed on the underside, and two FSS 191, 292.

FIGS. 1 and 2A indicate that stack-up structure 110 has an almost-circular shape (e.g., a circular shape having a chord cutting across one end to replace a circular segment) having a circumferential edge 104 and a chord edge 106. It is contemplated that stack-up structure 110 may encompass other shapes that may be suitably used for radiation of the RF wave therefrom. The disclosed almost-circular shape of antenna 100 provides an exemplary structure of an effective configuration, but is not intended to be limiting, as other antenna shapes may be applied in accordance with the inventive concepts disclosed heretofore.

The first control layer 101 of antenna 100 includes vertical-polarization peripheral ports 151 that are configured to receive and transmit EM waves in a vertical polarization. The vertical-polarization peripheral ports 151 are also referred to herein as vertical-polarization peripheral radiating elements 151. As illustrated in FIG. 1, vertical-polarization peripheral ports 151 may be located on the periphery of the first control layer 101, distributed radially around the circumference of the first control layer 101, and may be proximate to circumferential edge 104 of antenna 100.

The second control layer 202 of antenna 100 has horizontal-polarization peripheral ports 252, configured to receive and transmit EM waves in a horizontal polarization. The horizontal-polarization peripheral ports 151 are also referred to herein as horizontal-polarization peripheral radiating elements 252. As illustrated in FIG. 1, the horizontal-polarization peripheral ports 252 may be located on the periphery of the second control layer 202, distributed radially around the circumference of the second control layer 202, and may be proximate to circumferential edge 104.

Figure 2B:
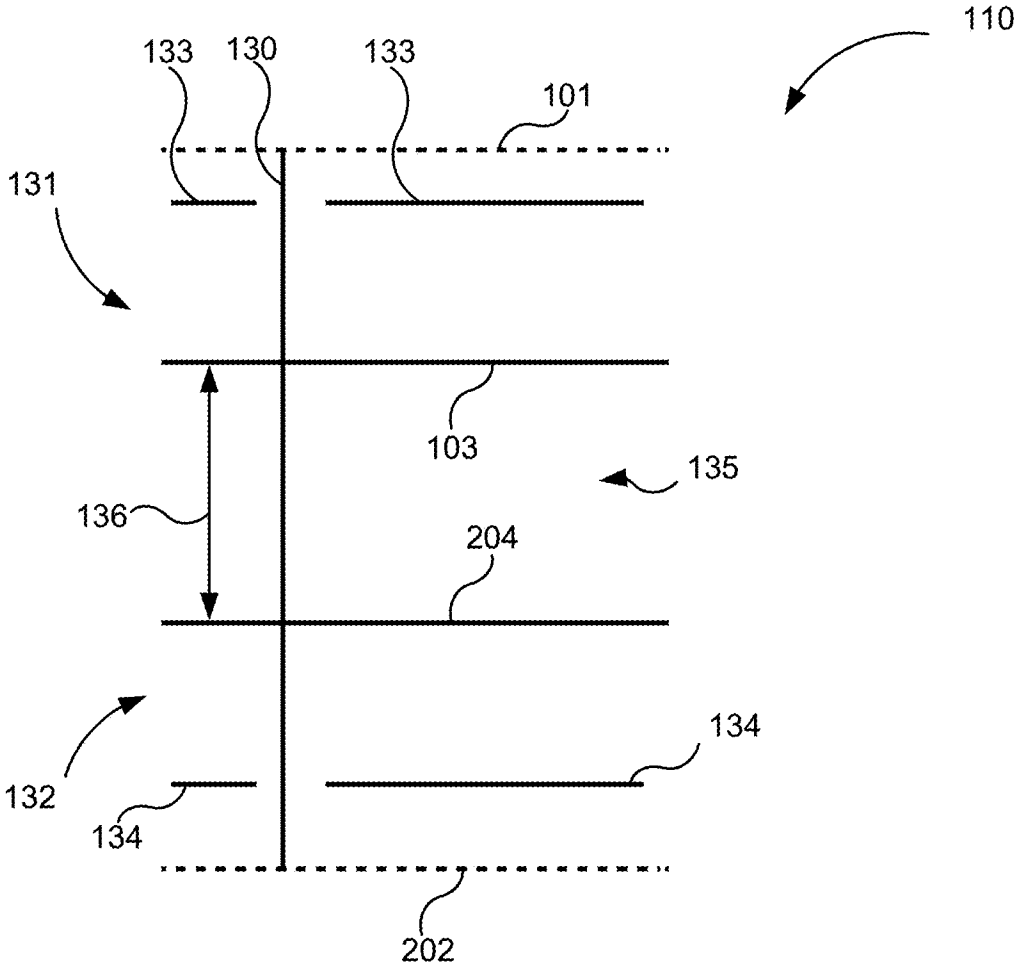
FIG. 2B depicts an enlarged partial cross section view of the stack-up structure of the antenna of FIG. 1, in accordance with various embodiments of the present disclosure.

Referring now to FIG. 2B, stack-up structure 110 has a first parallel-plate waveguide 131 and a second parallel-plate waveguide 132, two ground layers 103, 204 and two metal plates 133, 134, as well as first control layer 101 and second control layer 202. The metal plates 133, 134 along with a first ground layer 103 and a second ground layer 204 form two parallel-plate waveguides 131, 132. In at least one embodiment, waveguides 131, 132 are filled with a waveguide dielectric material, such as, for example, a dielectric composite material. In some portions of stack-up structure 110, a layer of dielectric material may cover the metal plates 133, 134 on the sides of first control layer 101 and second control layer 202, respectively.

The first ground layer 103 and the second ground layer 204 are located between the first control layer 101 and second control layer 202. The ground layers 103, 204 are connected to an electrical ground.

In illustrated embodiments, the distance between first control layer 101 and second control layer 202 is about a quarter of the wavelength. The first ground layer 103 and the second ground layer 204 may be separated by a spacer. In some embodiments, there is a spacing 135 between the first ground layer 103 and the second ground layer 204. The spacing width 136 is such that the total distance between first control layer 101 and second control layer 202 is about a quarter of the wavelength. Such spacing width 136 may be preferable for integration and operation of vertical-polarization peripheral ports 151, as discussed below.

The first control layer 101 and second control layer 202 are connected to each other by through vias 130 located in various places of stack-up structure 110. The through vias 130 (also referred to herein as "vias") go all the way through stack-up structure 110 and various elements located on first control layer 101 and second control layer 202 of antenna 100 may be connected to vias 130. The vias 130 are operatively connected to ground layers 103, 204. As illustrated in FIG. 2B, via 130 may be approximately perpendicular to first control layer 101 and second control layer 202. It should be noted that first control layer 101 and second control layer 202 are electrically isolated from each other because vias 130 are connected to electrical grounds.

The stack-up structure 110 may be made of a PCB. The dielectric materials used in the stack-up structure 110 may be those known in the art of the PCB technology. Alternatively, the stack-up structure 110 may be made with metallic plates which may be assembled with a circuit board, or using LTCC or liquid crystal polymer (LCP) technology.

Referring again to FIGS. 1 and 2A, two central ports 105, 206 may be located at or near a center of stack-up structure 110, one on first control layer 101 and the other on second control layer 202, respectively. The center of stack-up structure 110 is defined herein to be located at approximately equal distances from any point of circumferential edge 104 of antenna 100. It should be understood that central ports 105, 206 may be located at any other part of stack-up structure 110. The central ports 105, 206 may be operatively connected to one common via 130.

The central ports 105, 206 are configured to be sources of radiation of an EM wave. The RF wave may radiate radially from central ports 105, 206 into parallel-plate waveguides 131 and 132. The central ports 105, 206 are also configured to receive radiation from parallel-plate waveguides 131 and 132. Each central port 105, 206 is operatively connected to a corresponding RF connector 120, which, in its turn, is operatively connected to an RF signal source operated by an RF controller (not shown).

In order to be able to radiate efficiently at various steering angles θ, central ports 105, 206 may be optimized to provide similar gain for RF radiation in all, or in the most of, directions, or in a broad radiating angle range. In some embodiments, central ports 105, 206 provide similar gain in a desired frequency range of antenna 100.

Figure 3A:
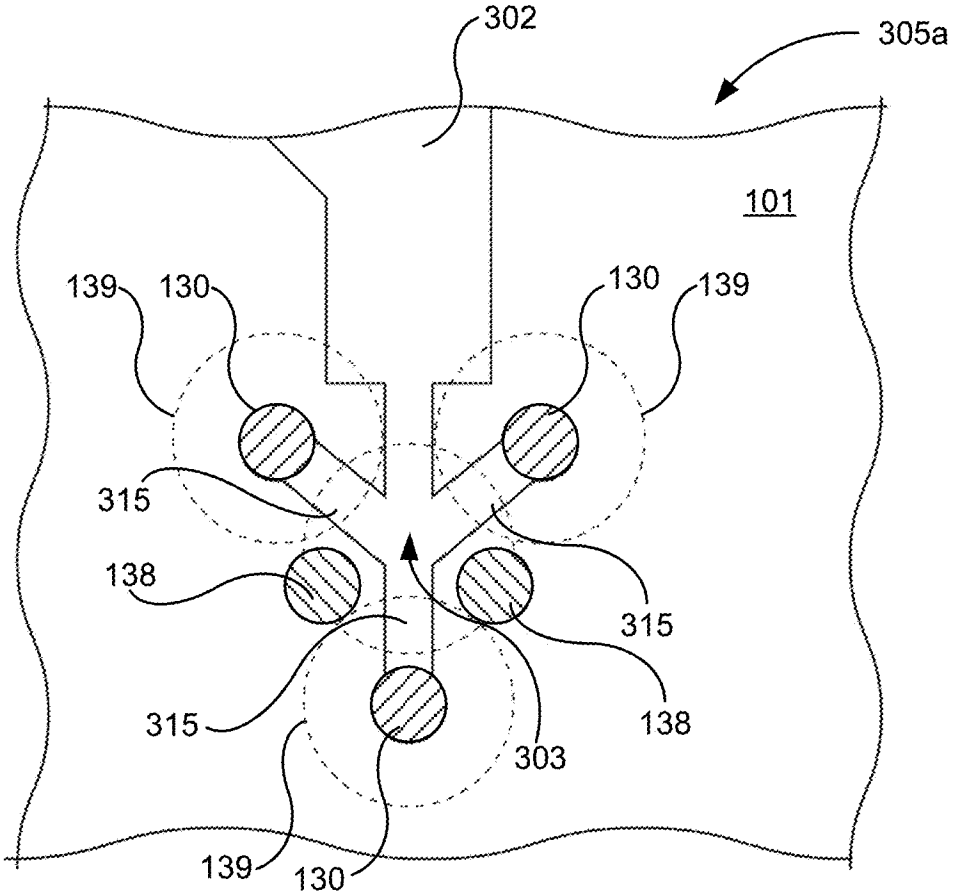
FIG. 3A depicts an enlarged top view of a central port, in accordance with various embodiments of the present disclosure.

FIG. 3A depicts an enlarged top view of central port 305*a*, in accordance with various embodiments of the present disclosure. The central port 305*a* has a feed 302 (for example, a microstrip line) operatively connected to three vias 130 by three respective leads 315. The length of the leads 315 may be, for example, 0.1 of the microstrip line guided wavelength.

In addition to three vias 130 in central port 305*a*, there are two grounded vias 138. Three vias 130 and two grounded vias 138 are operatively connected to ground layers 103, 204. Clearances, depicted with dashed lines 139, between vias 130 and metallic plates 133, 134 separate vias 130 from metallic plates 133, 134. The grounded vias 138 do not have such clearances around them.

In operation, RF signal is delivered from an RF connector 120 (as depicted in FIG. 1) through feed 302 to a center point 303. Leads 315 deliver RF signal to three vias 130 positioned radially from center point 303 of antenna 100. Three portions of vias 130, located inside stack-up structure 110, radiate RF wave into parallel-plate waveguides 131 and 132.

Figure 3B:
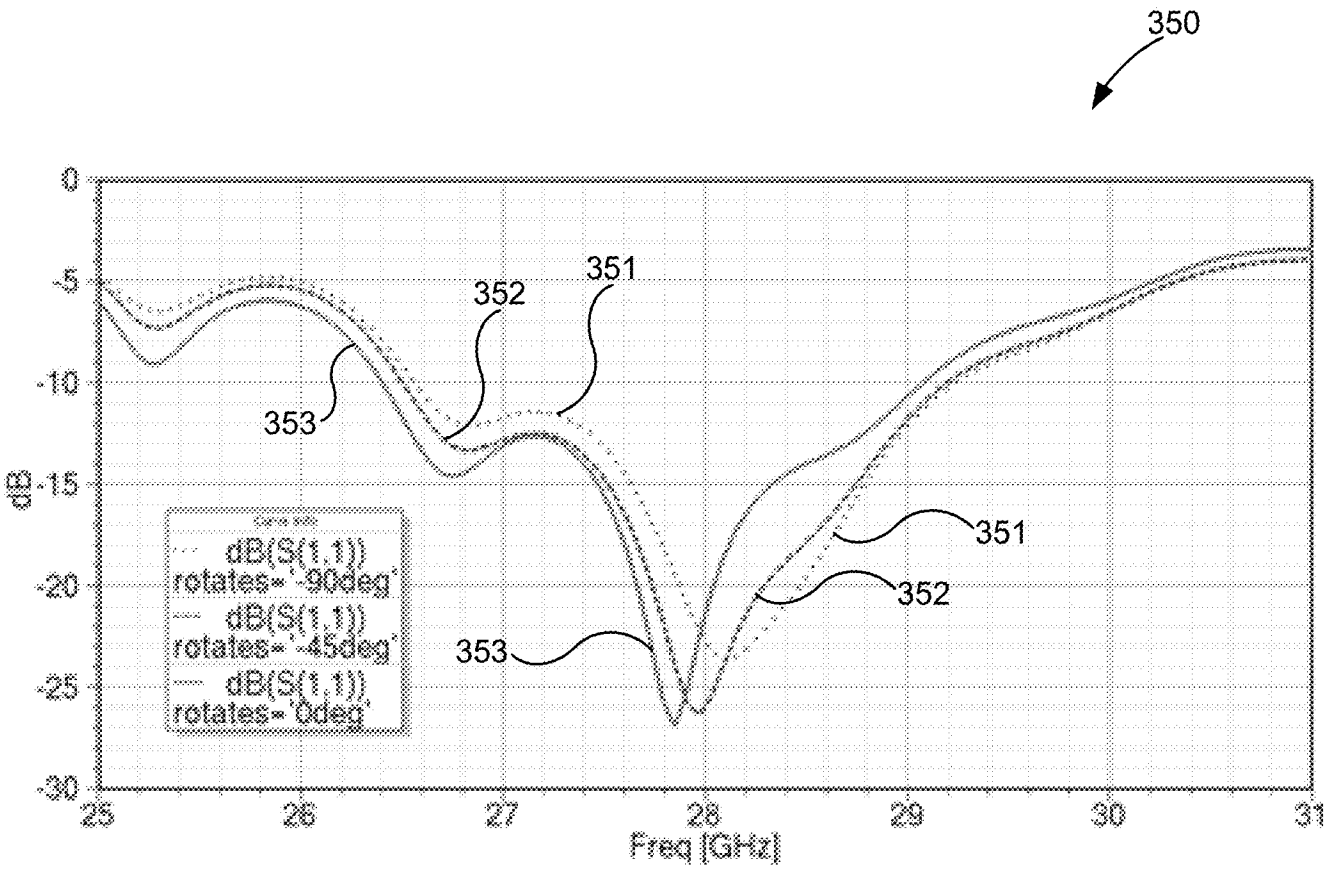
FIG. 3B illustrates a reflection coefficient (i.e., $S_{11}$-parameter) of the central port illustrated in FIG. 3A.

FIG. 3B illustrates a reflection coefficient 350 (i.e., $S_{11}$-parameter) of central port 305*a* illustrated in FIG. 3A. The reflection coefficient 350 is provided for different angles of transmission of the RF wave by central port 305*a*: at 90 degrees (line 351), at 45 degrees (line 352), and at 0 degrees (line 353). Reflection coefficients 351, 352, 353 are similar for any of these angles of radiation of the RF wave.

Figure 3C:
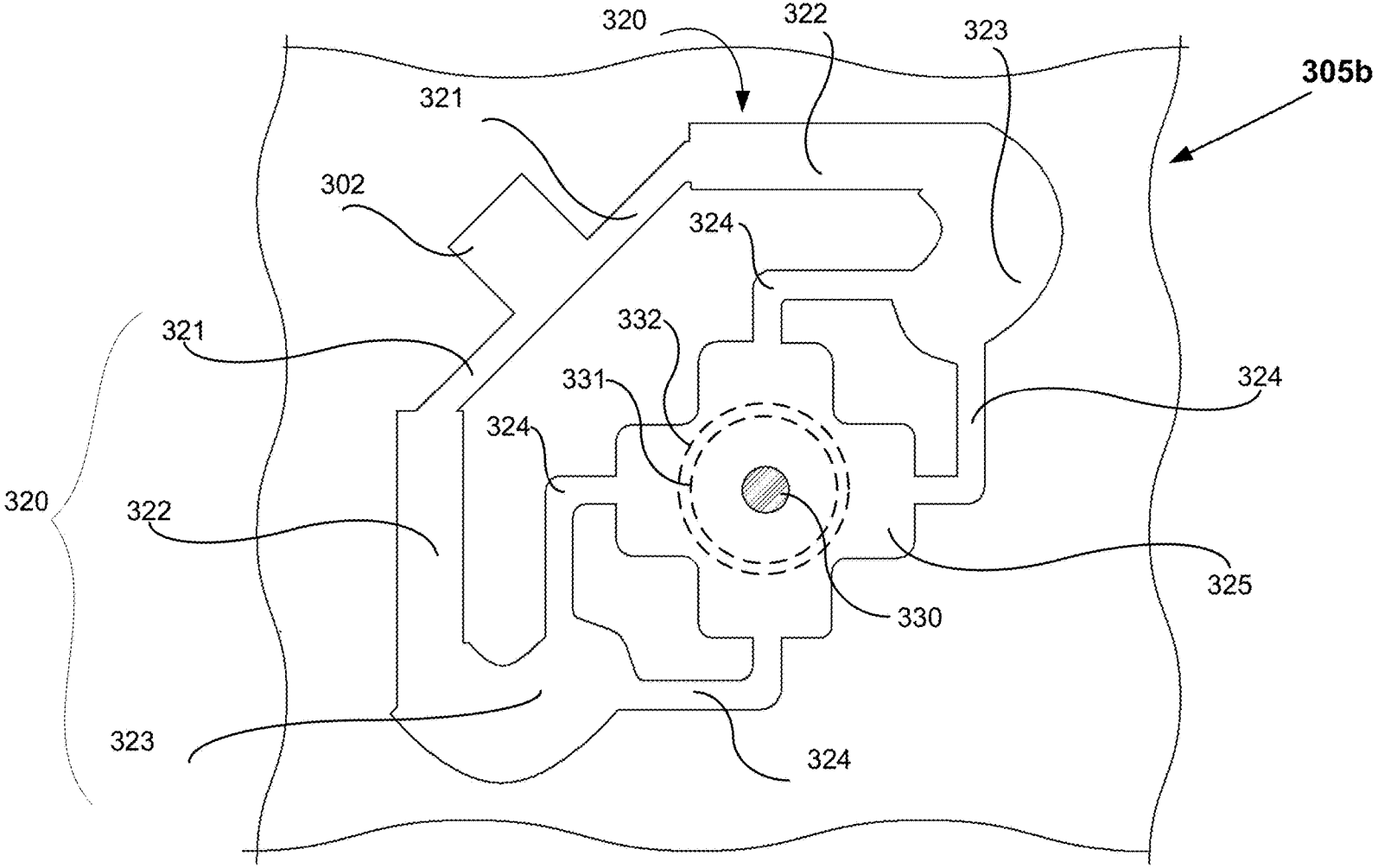
FIG. 3C depicts another central port, in accordance with various embodiments of the present disclosure.

FIG. 3C depicts another central port 305*b*, in accordance with various embodiments of the present disclosure. The central port 305*b* has a feed 302 (e.g., a microstrip line, which may also be referred to as a feeding microstrip) operatively connected to a pair of shoulders 320. In illustrated embodiment, the characteristic impedance of the feed 302 is 50 Ohm.

Each shoulder 320 comprises a first shoulder portion 321, a second shoulder portion 322 and a third shoulder portion 323 which are operatively connected to each other as illustrated in FIG. 3C. In some embodiments, characteristic impedance of first shoulder portion 321 is about 100 Ohm, characteristic impedance of second shoulder portion 322 is about 70 Ohm, and characteristic impedance of third shoulder portion 323 is about 50 Ohm.

Two sub-shoulders 324 are operatively connected to each third shoulder portion 323. In some embodiments, the impedance of the sub-shoulders 324 is about 100 Ohm. It should be understood that the shoulders 320 and sub-shoulders 324 may be made of a microstrip line having different widths at various portions, as illustrated in FIG. 3C. All four sub-shoulders 324 are then connected to a central microstrip 325, positioned in a center of antenna 100. Each sub-shoulder 324 is thus operatively connected to one of the pair of shoulders 320 on one end and to central microstrip 325 on the other end. In at least one embodiment, a distance between two neighboring sub-shoulders 324 at their respective connection points with the central microstrip 325 is approximately the same for each pair of neighboring sub-shoulders.

The central microstrip 325 is operatively connected to one central via 330, which is a through via. The portion of central via 330 located inside stack-up structure 110 is configured to radiate the RF wave into parallel-plate waveguides 131, 132. The dashed line 331 illustrates a metal circle (disk) surrounding central via 330 at the level of metal plates 133, 134. A clearance located between dashed lines 331 and 332 illustrated in FIG. 3C, separates via 330 from the metal plates 133, 134.

In some embodiments, central microstrip 325 has a symmetric shape. For example, central microstrip 325 may have a round shape, such as, for example, a circular shape, or a shape of a cross (as illustrated in FIG. 3C). The symmetric shape of central microstrip 325 permits supplying and distributing evenly the RF signal when it is delivered to via 330. The sub-shoulders may be configured to deliver RF energy to the central microstrip symmetrically with regards to the central via. Referring also to FIGS. 1, 2A and 2B, positioning sub-shoulders 324 at an equal distance from each other and around via 330, contributes to even radiation of EM wave from via 330 into parallel-plate waveguides 131, 132 of stack-up structure 110. In some embodiments, sub-shoulders 324 may be connected to central microstrip 325 at an equal distance from central via 330. The central microstrip 325 may be operatively connected to central via 330 in the middle of central microstrip 325.

The configuration of central port 305*b*, as depicted in FIG. 3C, may provide similar impedance matching characteristics at various angles.

Figure 3D:
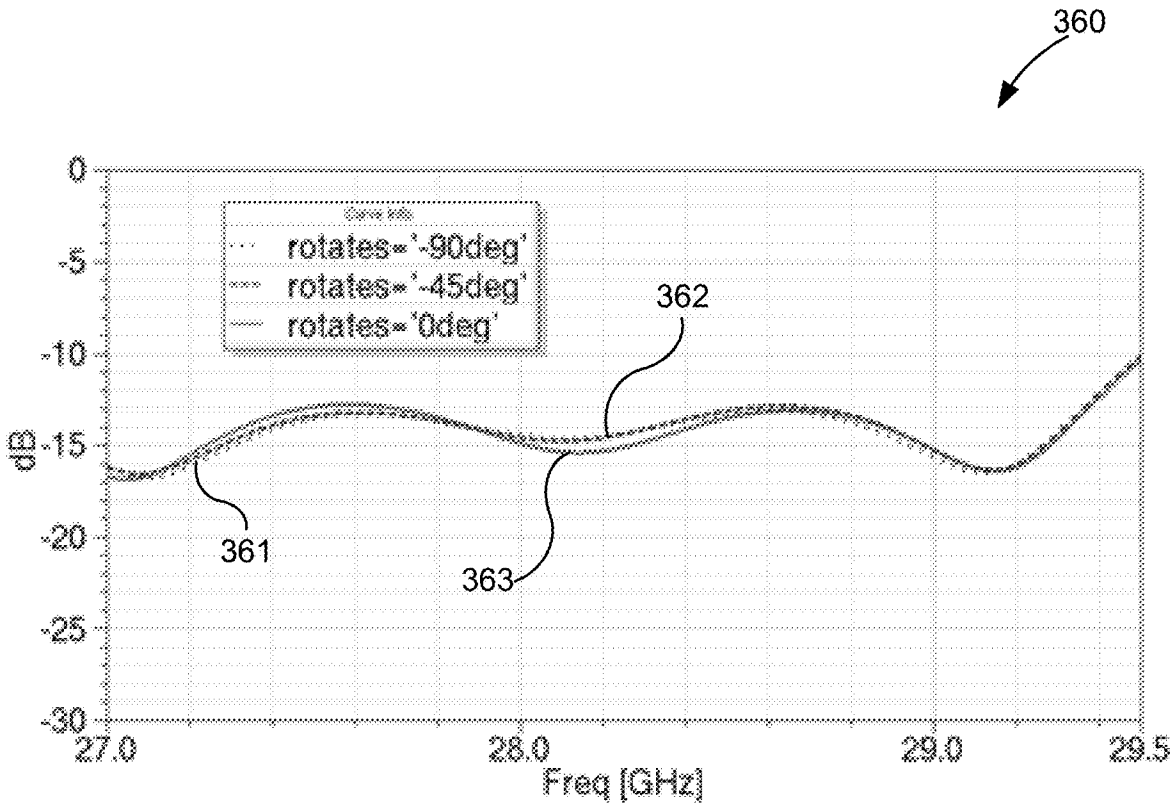
FIG. 3D depicts a reflection coefficient (i.e., $S_{11}$ parameter) simulated for the central port illustrated in FIG. 3C.

FIG. 3D depicts a reflection coefficient 360 (i.e., $S_{11}$ parameter) simulated for central port 305*b*, illustrated in FIG. 3C. As depicted in FIG. 3D, obtained $S_{11}$ parameter of central port 305*b* was between about −17 dB and −13 dB at frequencies between 28 GHz and 29.5 GHz. The reflection coefficient 360 is illustrated for three different steering angles θ of radiation of the RF wave from central port 105*b*: at 90 degrees (line 361), at 45 degrees (line 362), and at 0 degrees (line 363). Reflection coefficients 361, 362, 363 are similar for any of these angles of radiation of the RF wave. Moreover, as illustrated by FIG. 3D, central port 305*b* may provide similar impedance matching characteristics at various angles for the frequencies between about 27 GHz and 29.5 GHz.

It should be noted that, in some embodiments, all elements of central ports 305*a*, 305*b* are made of microstrips and are located on one of the surfaces of stack-up structure 110.

It should be understood that although central ports 105, 206 may be different from each other, they may have similar configuration. For example, central port 305*c* (FIG. 3C) may be used as central ports 105, 206 in FIGS. 1 and 2.

Figure 3E:
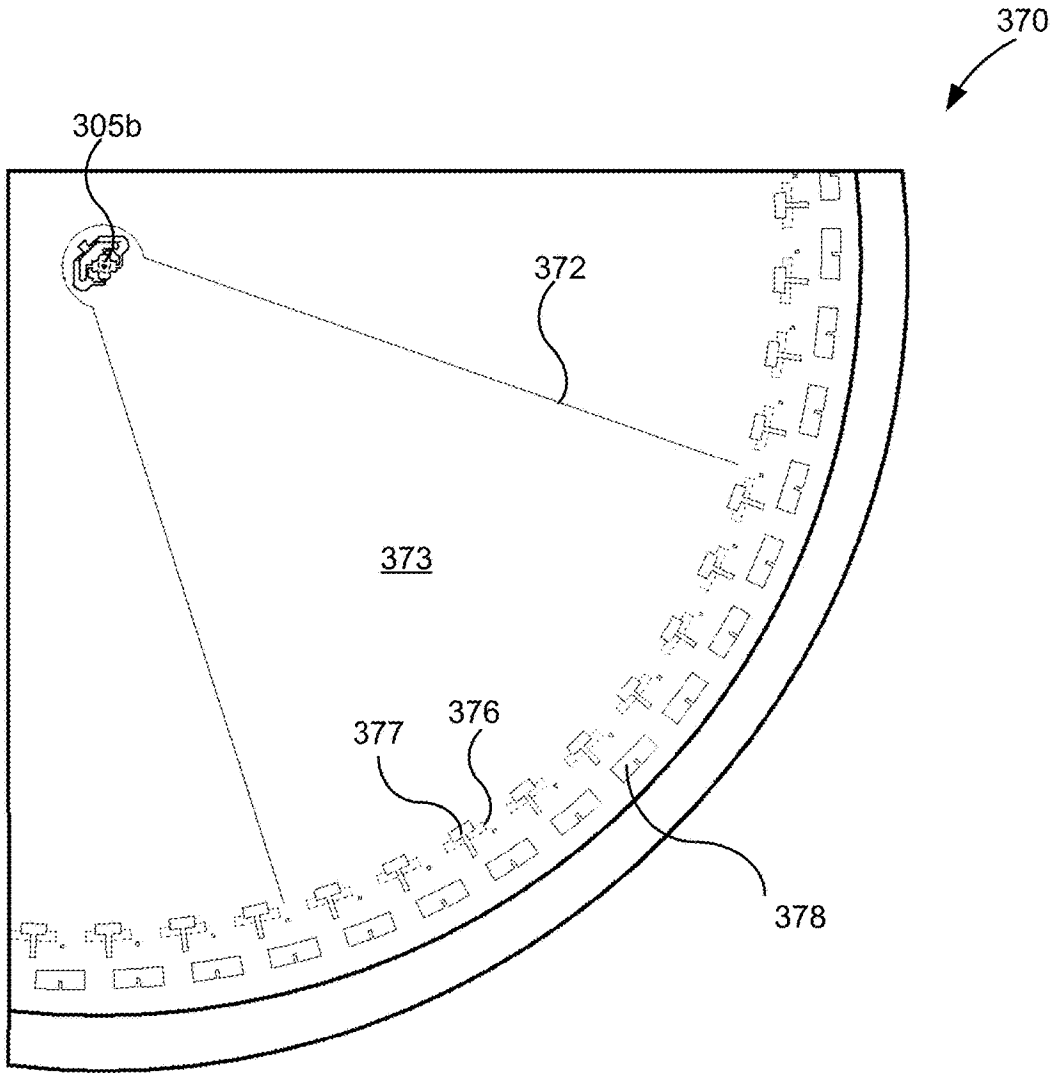
FIG. 3E illustrates a top view of an antenna structure for evaluating performance of the central port, in accordance with various embodiments of the present disclosure.

In order to determine reflection coefficients 350, 360 at different angles of transmission, performance of central ports 105, 206, 305*a*, 305*b* may be evaluated using a set-up illustrated in FIG. 3E.

FIG. 3E illustrates a top view of a power divider structure 370 for evaluating performance of central port 305*b*, in accordance with various embodiments of the present disclosure.

The power divider structure 370 comprises a parallel-plate horn-shape waveguide structure 373 (also referred to herein as "horn-shape waveguide") and metallic walls 372. The metallic walls 372 are designed to confine EM wave, generated by central port 305*b*, within horn-shape waveguide 373. As illustrated in FIG. 3E, metallic walls 372 partially surround central port 305*b*. The EM wave generated by central via 330 (depicted in FIG. 3C) of central port 305*b* is radiated towards output slots that couple with output microstrips 377. The metallic walls 372 may be configured to have a horn shape and may be made of a via fence.

The cross section of the power divider structure 370 is similar to the cross section of a portion of antenna 100, as depicted in FIG. 2B, considering only the section from first control layer 101 to first ground layer 103, and will be referred to here. Slots 376 are located in metal plate 133 at a periphery of power divider structure 370. The slots 376 are configured to radiate energy from the parallel-plate waveguide 131 and transmit it to output microstrips 377. The output microstrips 377 may have, for example, characteristic impedance of 50 Ohm. Blocks 378, that may be made of through vias, are located at the periphery of parallel-plate waveguide structure 370 in order to terminate parallel-plate waveguide 131. Distance between slots 376 and blocks 378 is a multiple of a quarter of the guided wavelength.

In at least one embodiment, output microstrips 377 may be connected to an analyzer (not depicted) which may permit evaluating of the transmission of EM wave inside power divider structure 370, when it is radiated from central port 305*c*. Various embodiments of the central port may be evaluated using the set-up of FIG. 3E.

In at least one embodiment, output microstrips 377 may be extended such that they pass through the row of blocks 378 toward the power divider structure 370. Such extended output microstrips 377 may be operatively connected to peripheral ports distributed radially from the central port and configured to receive EM wave from outside of the power divider structure 370 and to radiate the EM wave from the power divider structure 370. Such power divider structure 370 may be used to evaluate a concert operation of the central port (for example, central port 305*b*) and peripheral ports.

Referring again to FIGS. 1 and 2A, first control layer 101 has an array of vertical-polarization peripheral ports 151 and second control layer 202 has an array of horizontal-polarization peripheral ports 252.

Figure 4A:
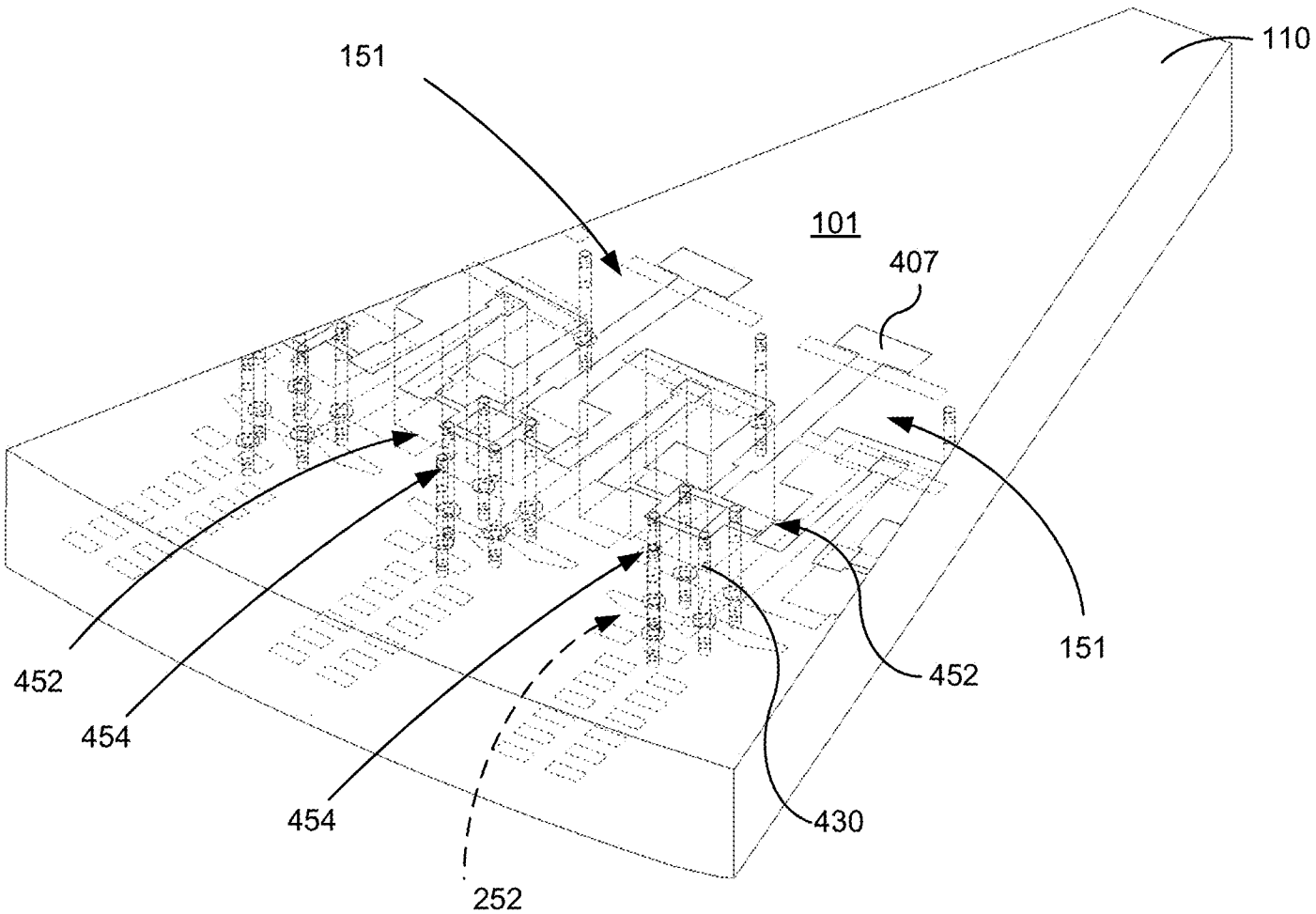
FIG. 4A depicts an enlarged perspective see-through view of a portion of the antenna of FIG. 1, illustrating vertical-polarization peripheral ports and horizontal-polarization peripheral ports, in accordance with various embodiments of the present disclosure.
Figure 4B:
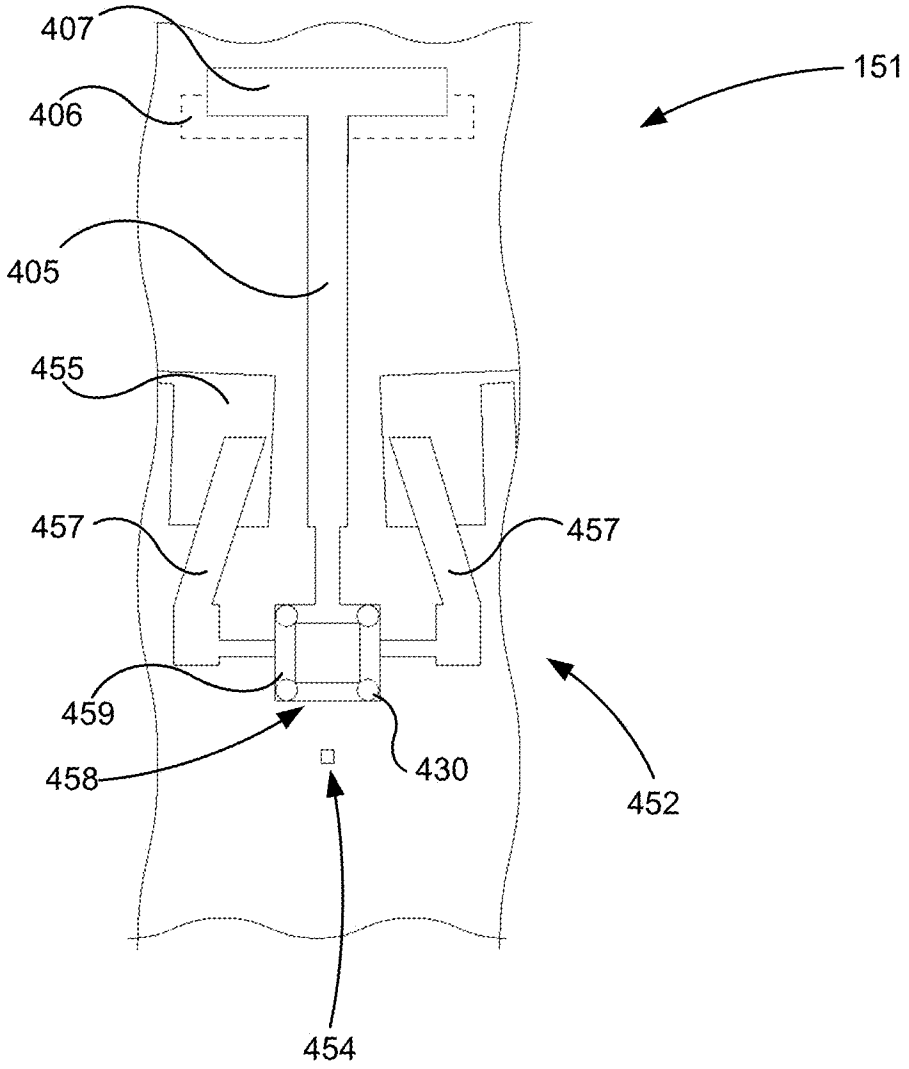
FIG. 4B depicts an enlarged top view of a vertical-polarization peripheral port of FIG. 4A.

FIG. 4A depicts an enlarged perspective see-through view of a portion of antenna 100, illustrating vertical-polarization peripheral ports 151 and horizontal-polarization peripheral ports 252, in accordance with at least one non-limiting embodiment of the present technology. FIG. 4B depicts a top view of vertical-polarization peripheral port 151 of FIG. 4A.

The vertical-polarization peripheral port 151 is configured to comprise a modified three-dimensional inverted F antenna (IFA) 452 and an additional via operating as a director 454.

The modified three-dimensional IFA 452 is configured to have two blocks 455 of vias, operatively connected to ground layer 103, two inductance lines 457, each operatively connected to block 455 of vias on one end, and to a monopole 458 made of four vias 430 on another end. The four vias of the monopole 430 are through vias. The four vias of the monopole 430 are interconnected with each other by a monopole microstrip 459 and form monopole 458 that receives and radiates EM energy in vertical polarization to and from antenna 100.

The additional via 454 is located at a distance of about a quarter of the wavelength from the modified-IFA monopole. The additional via 454 helps to increase the directional gain.

The monopole microstrip 459 is operatively connected to a transmission microstrip 405 that couples the EM wave from parallel-plate waveguide 131 to vertical-polarization peripheral port 151 and vice versa. Coupling of the EM wave to and from parallel-plate waveguide 131 is made through a transition slot 406, located in plate 133, and a coupling pad 407 of transmission microstrip 405.

Figure 4C:
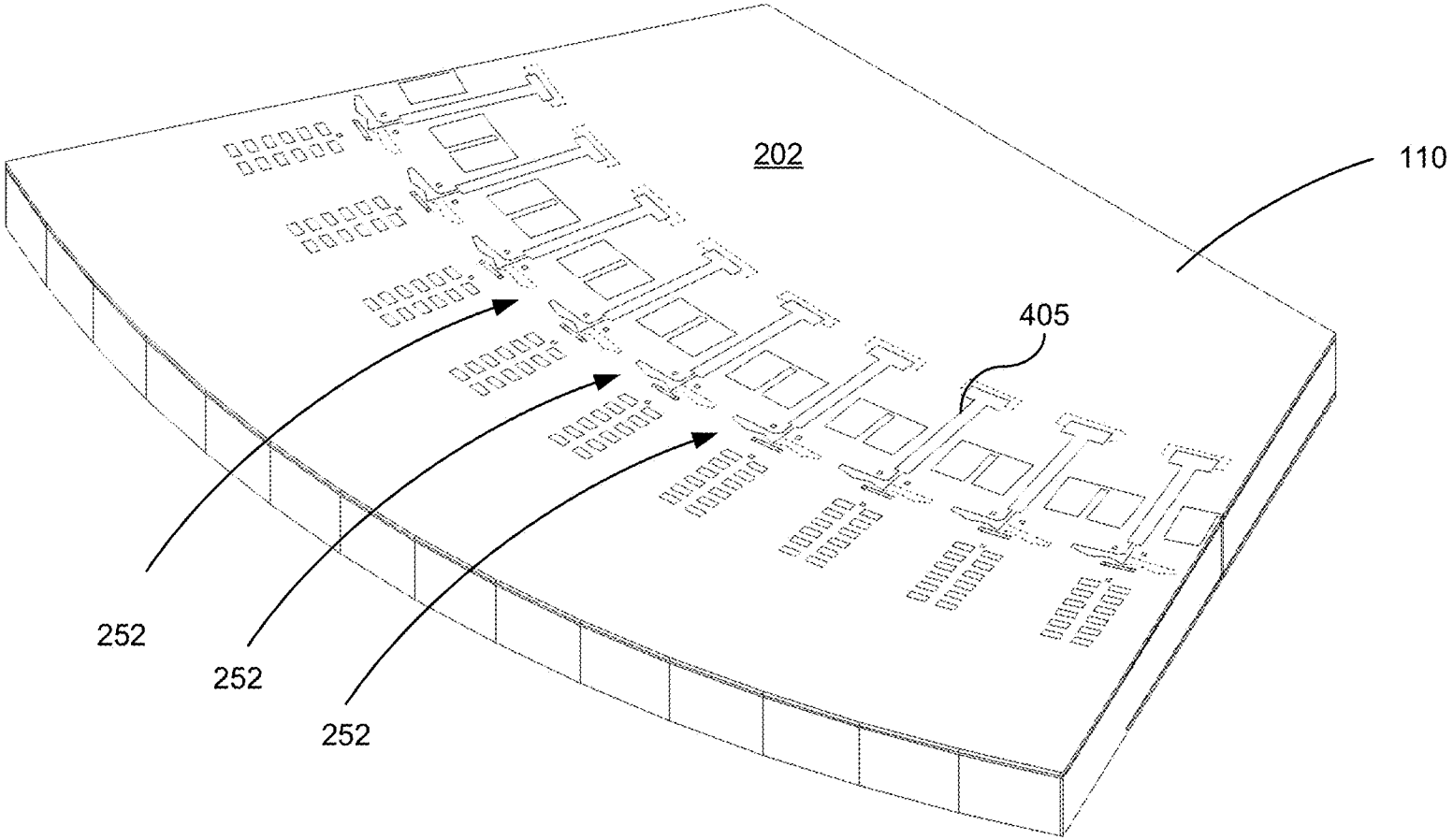
FIG. 4C depicts an enlarged bottom perspective view of a portion of the antenna of FIG. 1, illustrating horizontal-polarization peripheral ports, in accordance with various embodiments of the present disclosure.
Figure 4D:
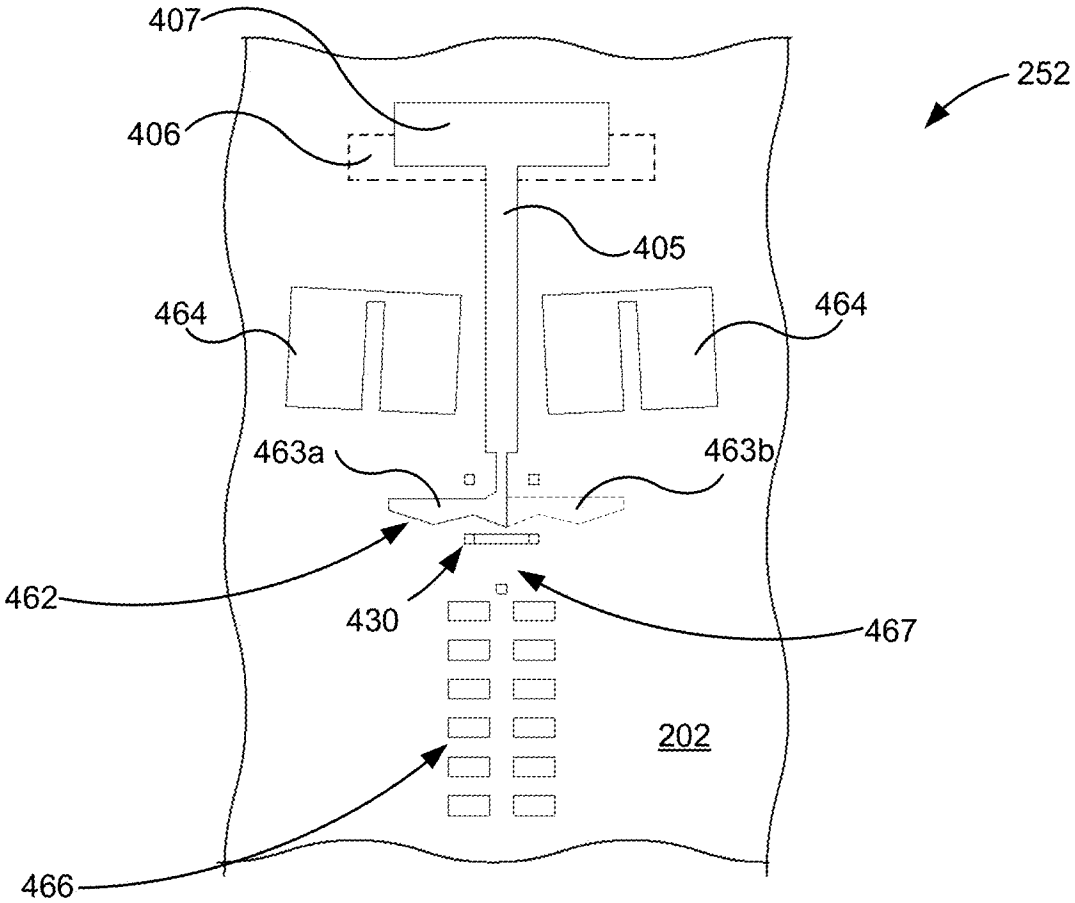
FIG. 4D depicts an enlarged top view of a horizontal-polarization peripheral port of FIG. 4A.

FIG. 4C depicts an enlarged bottom perspective view of a portion of antenna 100 illustrating horizontal-polarization peripheral ports 252, in accordance with at least one non-limiting embodiment of the present technology. FIG. 4D depicts an enlarged bottom view of a portion of antenna 100 illustrating horizontal-polarization peripheral port 252, in accordance with at least one non-limiting embodiment of the present technology.

The horizontal-polarization peripheral port 252 comprises a dipole 462, block structures 464 and a director structure 466. The dipole 462 may be a printed dipole and may be located partially on horizontal-polarization surface 202 and partially on the metal plate 134 of stack-up structure 110, which is depicted in FIG. 2B. The first and the second branches 463*a*, 463*b* of dipole 462 may thus be located in different planes. With reference to FIG. 2B and FIG. 4C, first dipole branch 463*a* is located on second control layer 202, and the second dipole branch 463*b* is located on the metal plate 134. The second dipole branch 463*b* is connected to the electrical ground. The director structure 466 is configured to increase directivity of EM wave.

The vertical-polarization peripheral ports 151 and horizontal-polarization peripheral ports 252 are collocated such that both structures may be complementary to each other.

Referring to FIGS. 4A-4D, ground blocks 464 of through vias are used in both vertical-polarization peripheral ports 151 and horizontal-polarization peripheral ports 252. The vias 430 of monopole 458 of vertical-polarization port 151 may also be connected to each other at horizontal-polarization surface 202 by a microstrip of a block line 467, located in front of dipole 462 of horizontal-polarization peripheral ports 252.

Referring again to FIG. 4A-4D, dipole 462 and monopole 458 are collocated and cross each other. In illustrated embodiment, the collocation is possible because monopole 458 is created by the placement of four vias 430 providing a space between vias 430 for dipole 462. The four vias 430 of the monopole 458 permit locating dipole 462 inside the monopole 458 such that dipole 462 and monopole 458 cross each other. The collocation and crossing of dipole 462 with monopole 458 increases symmetry and reduces coupling between the dipole 462 and monopole 458.

Figure 5A:
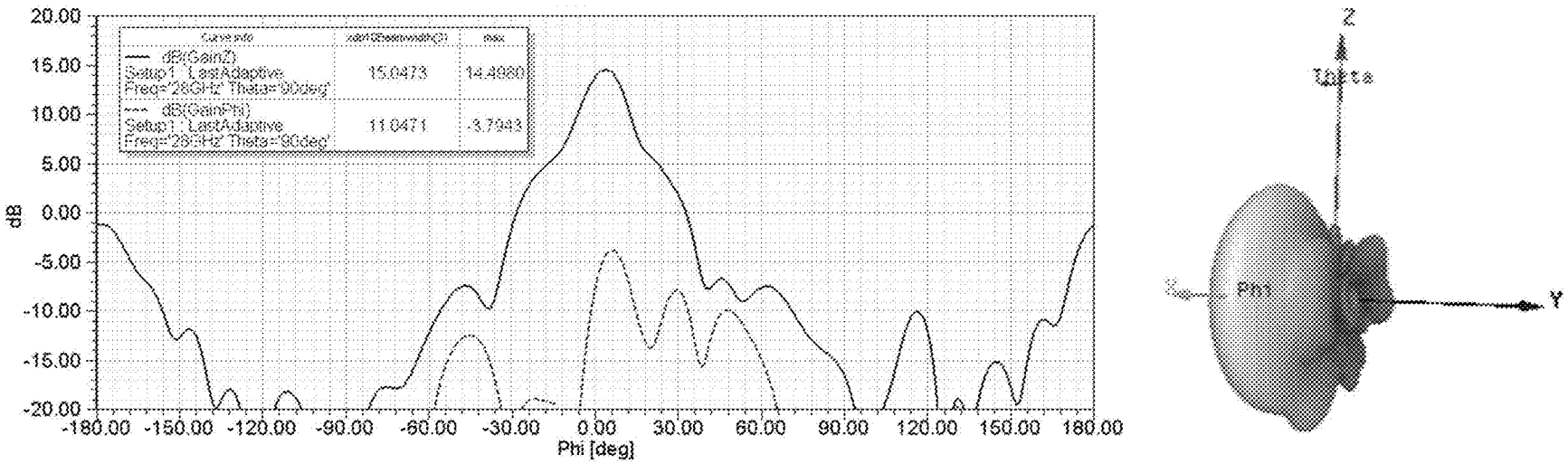
FIG. 5A depicts radiation patterns of vertical-polarization peripheral ports, in accordance with various embodiments of the present disclosure.
Figure 5B:
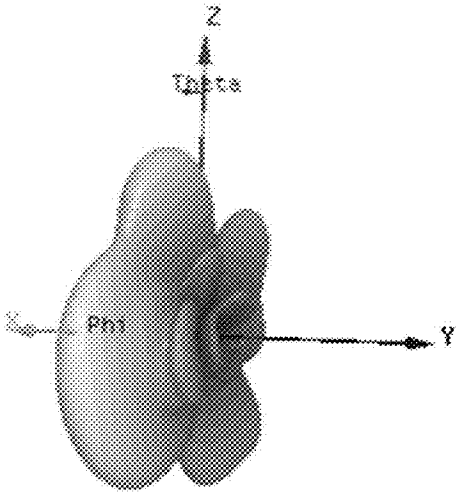
FIG. 5B depicts radiation patterns of horizontal-polarization peripheral ports, in accordance with various embodiments of the present disclosure.
Figure 5B:
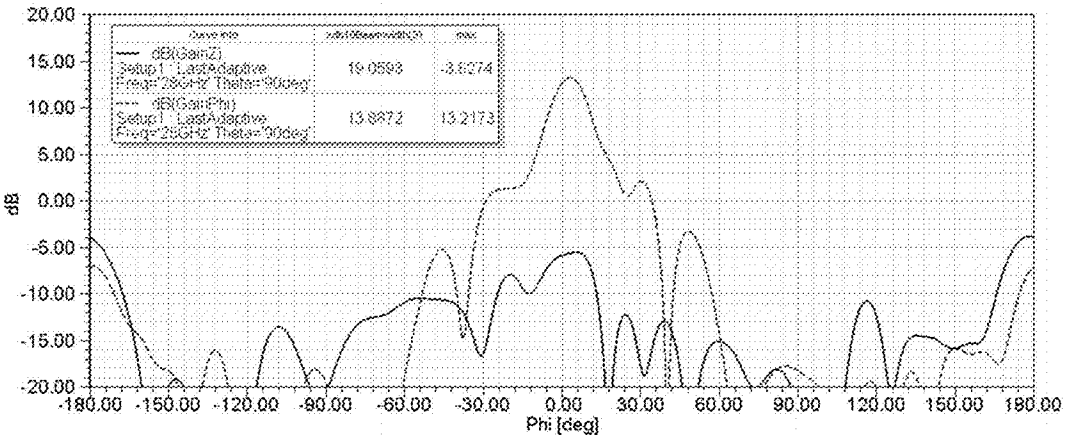

FIG. 5A and FIG. 5B depict radiation patterns for vertical-polarization peripheral ports 151 and horizontal-polarization peripheral ports 252, respectively, in accordance with at least one non-limiting embodiment of the present technology.

It should be noted that, in at least one embodiment, vias 130, 430 of antenna 100 are through vias, which is generally cheaper to fabricate than other types of vias.

The number of vertical-polarization peripheral ports 151 and horizontal-polarization peripheral ports 252 may be determined from the radius of the stack-up structure 110 and a distance between neighboring peripheral ports, either between neighboring vertical-polarization peripheral ports 151 on first control layer 101 or between neighboring horizontal-polarization peripheral ports 252 on second control layer 202. In some embodiments, the distance between vertical-polarization peripheral ports 151 is approximately half of the wavelength. The radius of the stack-up structure 110 is determined by the desired gain and directivity of the antenna 100.

Referring again to FIG. 1, FIG. 2A, and FIG. 2B, two FSS 191, 292 are located on first control layer 101 and second control layer 202, respectively. Both FSS 191, 292 are integrated with stack-up structure 110 and comprise a plurality of FSEs 600 operatively connected to through vias 130 of stack-up structure 110.

Not only are FSS 191, 292 integrated with stack-up structure 110, they are also integrated with each other because they are both operatively connected to through vias 130 of stack-up structure 110.

The structure of FSE 600 will now be described in further detail.

Figure 6A:
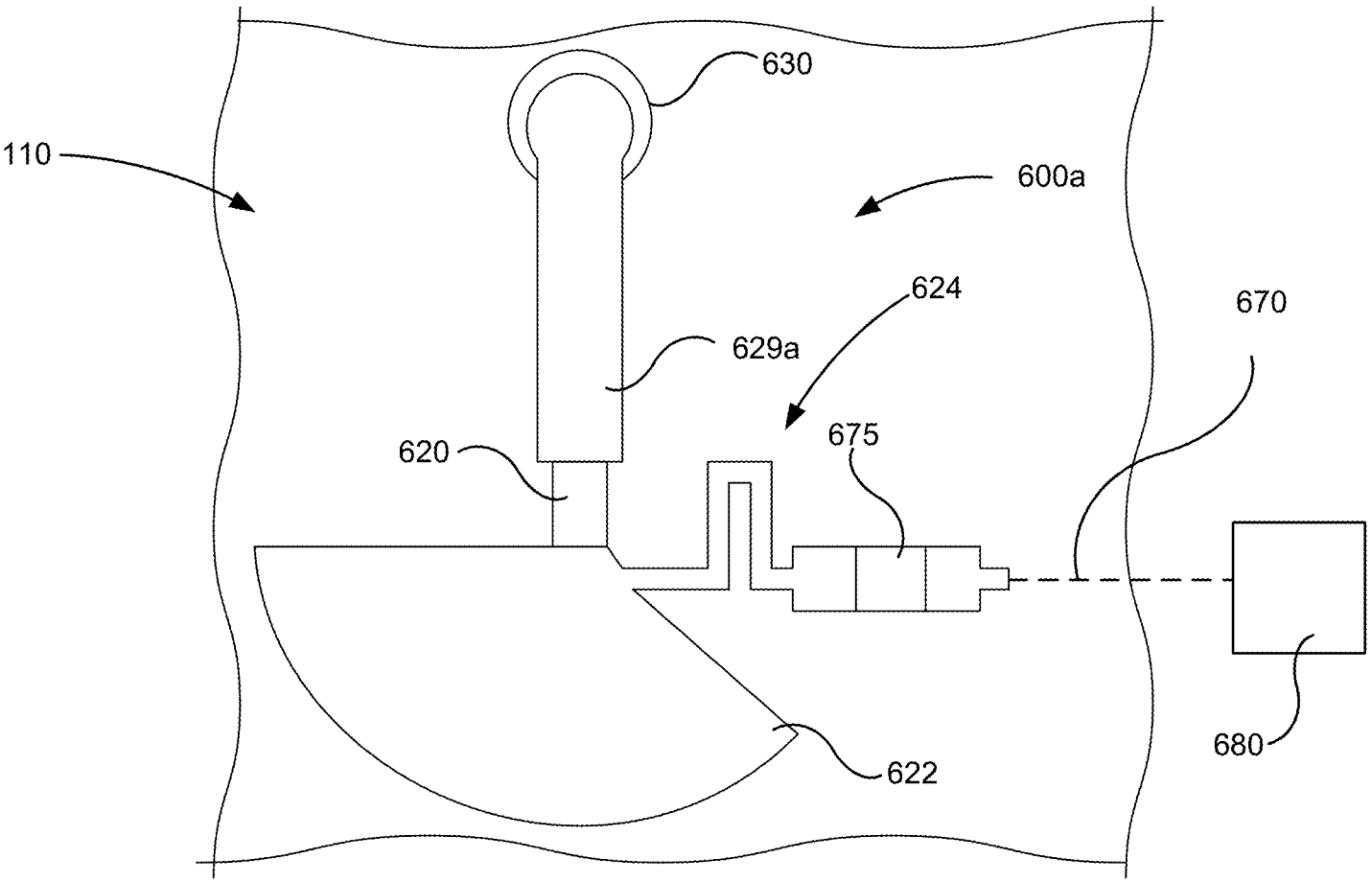
FIG. 6A depicts a top view of a frequency-selective element (FSE) in a portion of the antenna of FIG. 1, in accordance with various embodiments of the present disclosure.
Figure 6C:
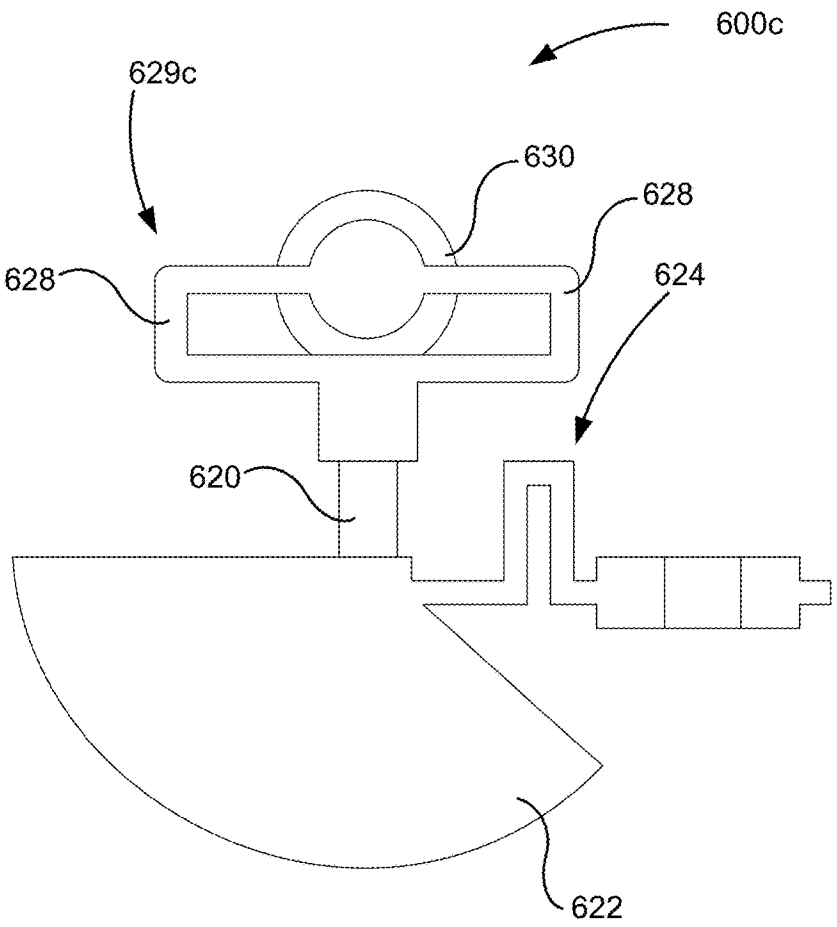
FIG. 6C depicts yet another FSE in a portion of the antenna of FIG. 1, in accordance with various embodiments of the present disclosure.
Figure 6B:
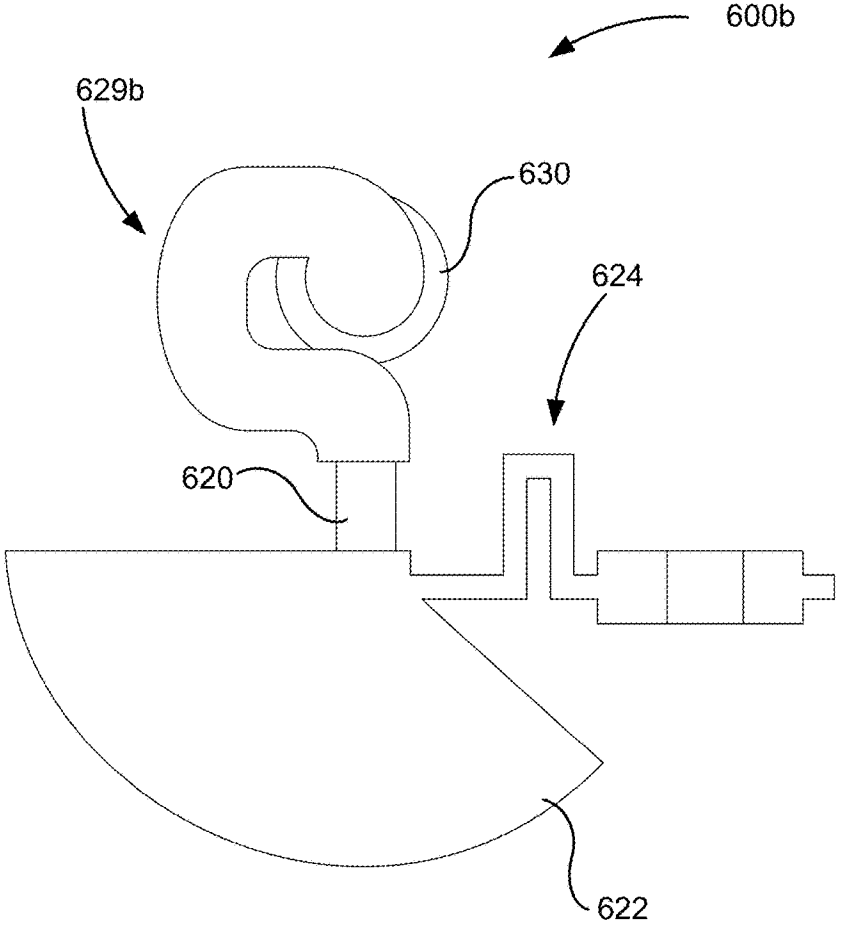
FIG. 6B depicts another FSE in a portion of the antenna of FIG. 1, in accordance with various embodiments of the present disclosure.
Figure 6D:
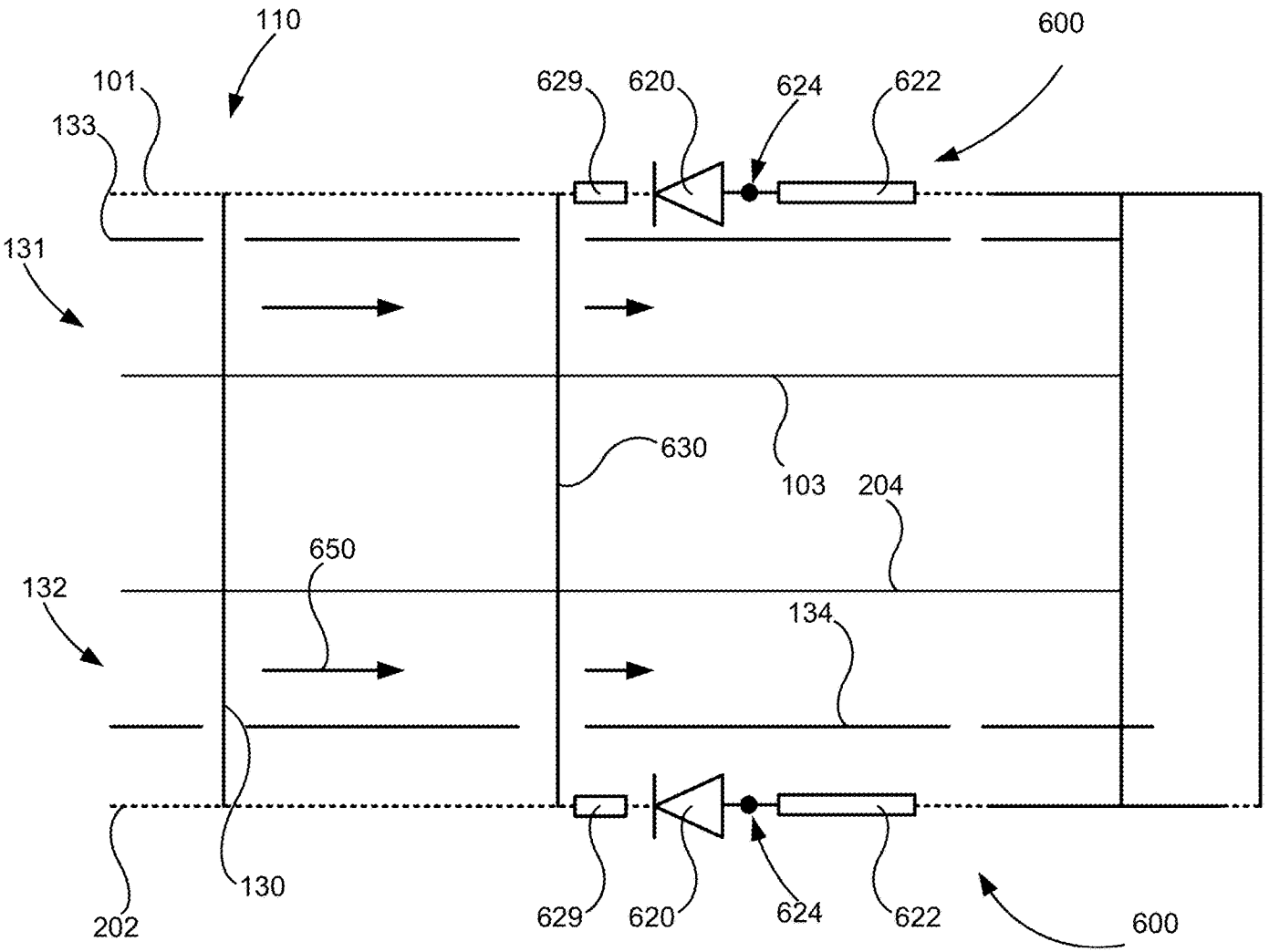
FIG. 6D illustrates an elevation side view of the FSE and a surrounding portion of the antenna of FIG. 1, in accordance with various embodiments of the present disclosure.

FIGS. 6A-6C depict top views of various configurations of FSE 600 (600*a*, 600*b*, and 600*c*) in a portion of antenna 100, in accordance with various embodiments of the present disclosure. FIG. 6D illustrates an elevation side view of FSE 600 and a surrounding portion of antenna 100, in accordance with various embodiments of the present disclosure.

The FSE 600 is operably connected to via 630 and has a switchable element 620, a radial stub 622, and a direct current (DC) circuit 624. FSE 600 also has a stub connector 629 (629*a*, 629*b*, 629*c* in FIGS. 6A-6C, respectively) that operatively connects via 630 to switchable element 620.

The radial stub 622 is illustrated as an open-ended radial stub. The length of the radial stub is determined by ¼ of the microstrip line guided wavelength ($\lambda_g$). The radial stub 622 may be implemented as any of a microstrip, a substrate integrated waveguide, a stripline, a coplanar waveguide, or the like. The radial stub 622 is configured to choke high frequencies while passing low frequencies when the current received by the radial stub is higher than a threshold. The open-ended radial stub 622 provides a ground to RF signal, while not grounding the DC signal.

The switchable element 620 may be a PIN diode, such as a beam lead PIN diode. In at least one another embodiment, switchable element 620 may be a microelectromechanical systems (MEMS) element.

The switchable element 620 of the FSE 600 is operatively connected to radial stub 622 and to via 630. The switchable element 620 may also be connected through DC circuit 624 and DC line 670 to a controller 680.

The controller 680 may be, for example, a DC voltage controller. The DC circuit 624 has a resistor 675, which allows controlling the current of the switchable element 620. The resistor 675 may be a millimeter wave thin film resistor or a regular thick film resistor.

The controller 680 may operate the switchable element 620 that is configured to actuate voltage/current supplied to radial stub 622 and control the operation of switchable element 620 by switching it to ON or OFF operation mode.

When switchable element 620 is in ON operation mode, the switchable element 620 acts as a resistance, equivalent to serial resistance of switchable element 620 (for example, to the serial resistance of the PIN diode). When switchable element 620 is in OFF operation mode, the switchable element 620 acts as a capacitor. When switchable element 620 is in OFF mode, the EM wave 650 continues its propagation in first parallel-plate waveguide 131 or second parallel-plate waveguide 132.

By increasing or decreasing the length of connector stub 629 by a quarter wavelength, one may invert the ON and OFF effect of FSE. That is, when the switchable element 620 is OFF, FSE 600 does not permit (e.g. it prevents) propagation of EM wave 650. When switchable element 620 is ON, FSE 600 permits (allows) propagation of EM wave 650.

Referring again to FIG. 6D, stack-up structure 110 has a first parallel-plate waveguide 131 and a second parallel-plate waveguide 132, ground layers 103, 204, first control layer 101 and second control layer 202, as well as first metal plate 133 and second metal plate 134, as discussed above.

One FSE 600 is located on first control layer 101 and connected to via 630. Another FSE 600 is located on an opposite side of stack-up structure 110, i.e. on second control layer 202.

The via 630 is electrically connected to ground layer 103 and passes through an aperture formed in first control layer 101 and metal plates 133, 134 through another aperture in second control layer 202 to join FSE 600 located on the second control layer 202.

On horizontal-polarization surface 202, via 630 is operatively connected to another stub connector 629, which is operatively connected to another switchable element 620, operatively connected to radial stub 622. The switchable element 620 may be also connected through DC circuit 624 to a controller 680.

It should be noted that FSE 600 on second control layer 202 may be similar to FSE 600 on first control layer 101, with similar structural elements and parameters.

Each FSE 600, and in particular, each switchable element 620 may be operatively connected, through a separate DC connection line 670 to DC controller 480. The controller 680 is configured to control switchable elements 620 by operating each of them between ON and OFF operation modes.

Referring now also to FIG. 1, the FSEs 600 of FSS 191, 192 may be operatively connected to one or two DC connectors 181, 182 (depicted in FIG. 1), which are then operatively connected to the DC controller 680 (not shown in FIG. 1). The DC controller 680 may control beam direction for vertical and horizontal polarizations separately by controlling operation of FSEs 600 and in particular, operation of the switchable elements of FSEs 600. It should be noted that although each switchable element 620 is connected to the controller 680 with a DC line 670, only several DC lines 670 are illustrated in FIGS. 1 and 2A to simplify the drawing.

It should be noted that there may be one DC controller 680 for both polarizations or there may be a separate DC controller for each polarization. It should also be understood that each switchable element 620, and therefore, each FSE 600, may be controlled separately. Alternatively, switchable elements 620 may be grouped as discussed below.

The FSEs 600 are configured to permit propagation of the RF wave when switchable element 620 is in OFF operation mode. When switchable element 620 is in ON operation mode, the RF wave is captured by radial stubs 622 and therefore FSE 600 blocks the RF wave from further propagation towards the circumferential edge 104 of stack-up structure 110.

Various configurations of FSE 600 are depicted in FIGS. 6A-6C. In particular, different configurations of stub connector 629 may be used in FSE 600. The stub connector 629 may have a circular, hook-like shape, as depicted in FIG. 6B.

FIG. 6C depicts a stub connector 629*c*, which is configured to have two stub arms 628, both originating from via 630 and leading to switchable element 620.

Figure 7A:
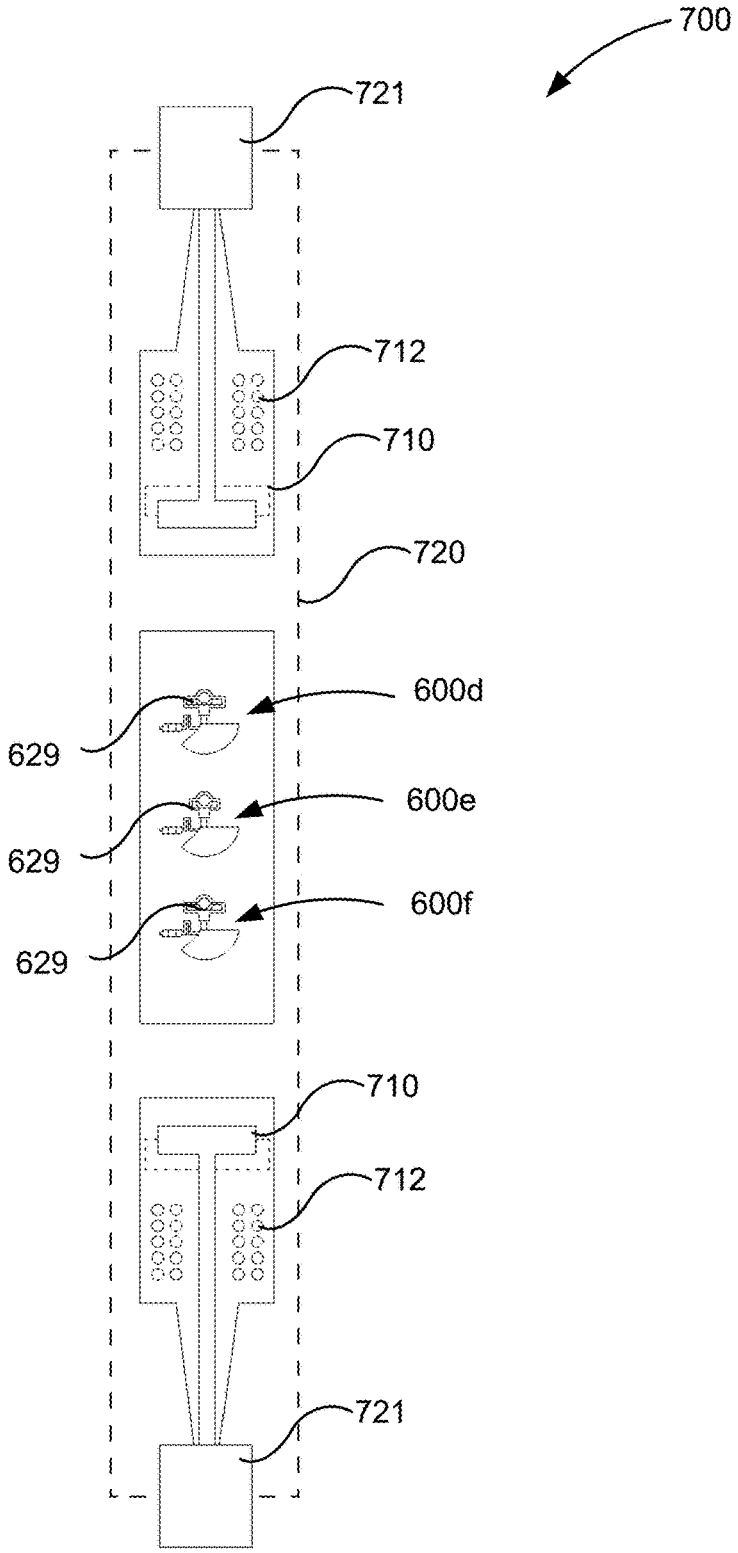
FIG. 7A depicts a top view of a rectangular waveguide which has three FSEs for determining parameters of the FSE of FIG. 6A-6D, in accordance with various embodiments of the present disclosure.

In order to determine a configuration of FSE 600, amplitudes of reflection and transmission coefficients of FSE 600 may be obtained using a rectangular waveguide 700 illustrated in FIG. 7A.

FIG. 7A depicts a top view of a rectangular waveguide 700 which has three FSEs 600 (600*d*, 600*e*, 600*f*) for determining parameters of FSE 600 of FIG. 6A-6D, in accordance with various embodiments of the present disclosure. The three FSEs 600 may be operated by a controller (not shown). In implementation, one may use such rectangular waveguide 700 to evaluate the operation of FSE 600 and to determine the optimal length of stub connectors 629 of FSEs 600.

Figure 7B:
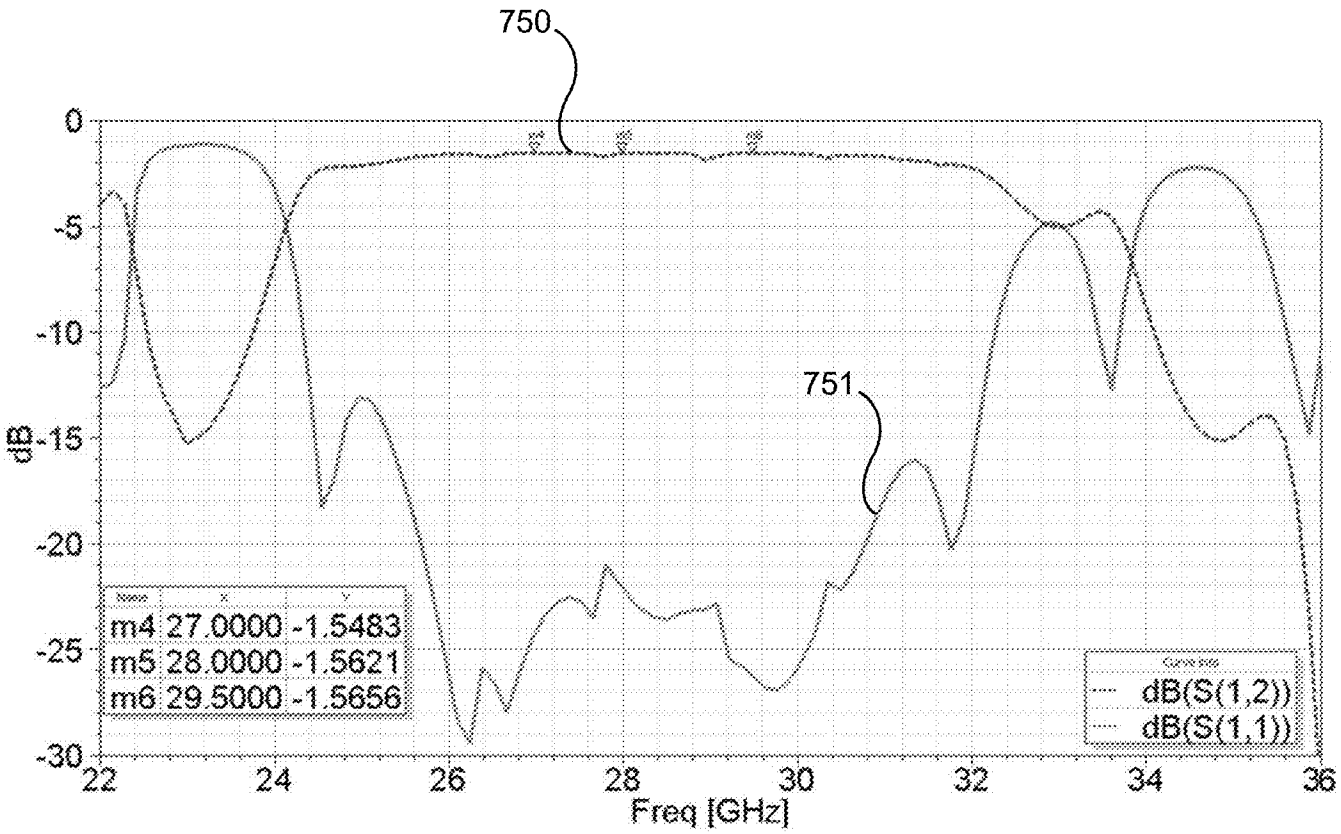
FIG. 7B depicts amplitudes of a transmission coefficient and a reflection coefficient of an RF wave propagating through the rectangular waveguide of FIG. 6C, when a frequency selective structure (FSS) is in OFF operational mode, in accordance with various embodiments of the present disclosure.

FIG. 7B depicts amplitudes of a transmission coefficient 750 and of a reflection coefficient 751 of RF wave propagating through rectangular waveguide 700 for FSE 600*c* depicted in FIG. 6C, when FSE 600*c* is in OFF operational mode, in accordance with at least one embodiment of the present disclosure.

Figure 7C:
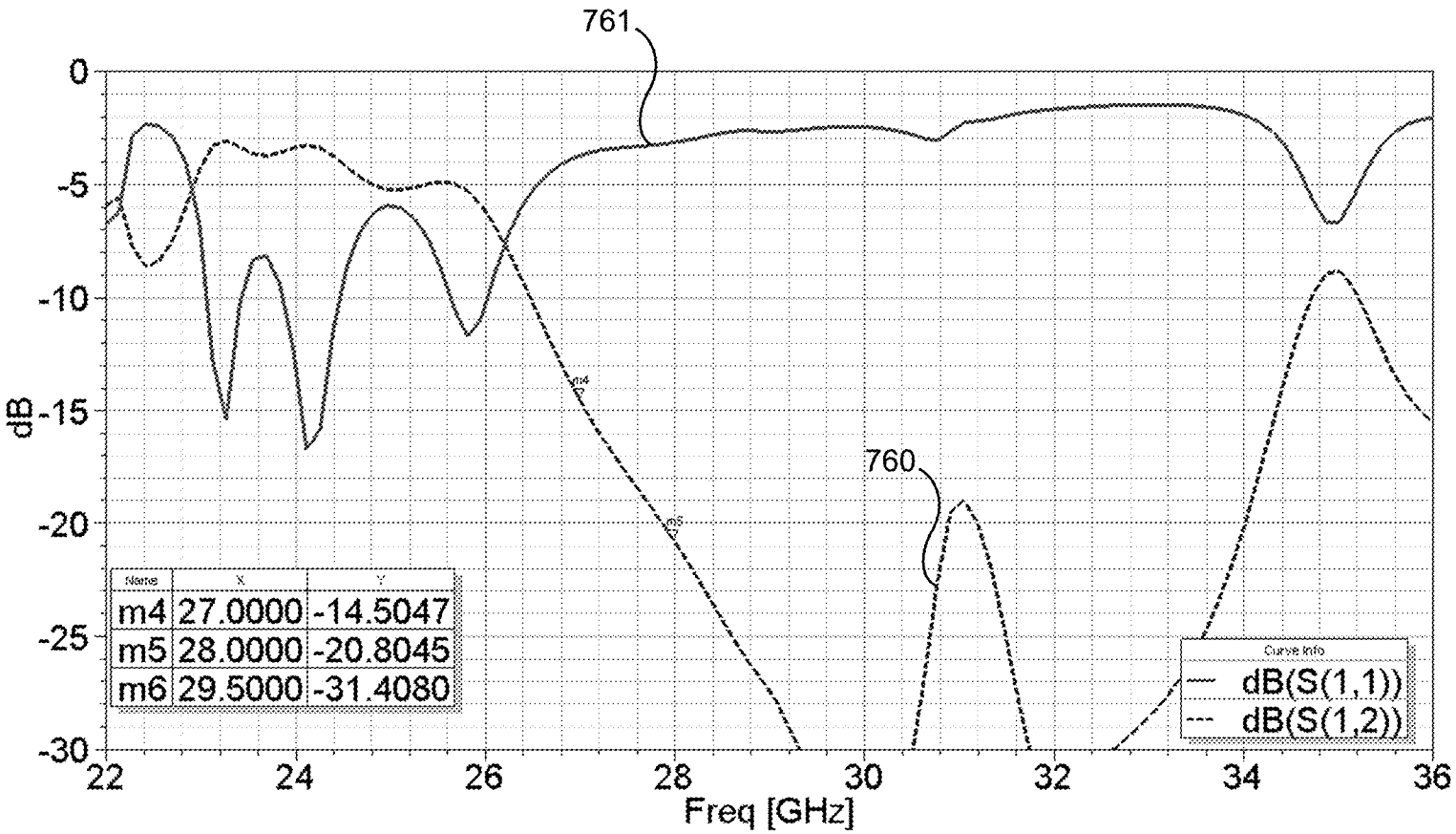
FIG. 7C depicts amplitudes of the transmission coefficient and the reflection coefficient of the RF wave propagating through the rectangular waveguide of FIG. 6C.

FIG. 7C depicts amplitudes of a transmission coefficient 760 and of a reflection coefficient 761 of RF wave propagating through rectangular waveguide 700 for FSE 600*c* depicted in FIG. 6C, when FSE 600*c* is in ON operational mode, in accordance with at least one embodiment of the present disclosure.

It should be noted that in order to obtain flat behavior of the transmission over a large frequency bandwidth, as depicted in FIG. 7B, one FSE 600 (for example, a FSE 600*e* in FIG. 7A), has shorter connector stub 629 by having shorter connector arms 628.

Referring to FIGS. 1 and 6A-6C, connector stub 629 (for example, 629*c*) may be made shorter in some of FSEs 600 of FSS 151. In at least one embodiment, one FSS row 115 may have FSEs 600 with longer connector stub 629, while the neighboring row 116 of the same FSS has FSEs 600 with shorter connector stub 629 compared to row 115. For example, some FSE rows 115 may have one length of connector stubs 629, and the other neighboring rows 116 may have shorter (or longer) length of connector stubs 629 in FSEs 600. For example, every second FSE row 116 may have FSE 600 with shorter connector stub 629. Such configuration of FSS 191 may result in smooth transmission characteristics over a broad frequency bandwidth of antenna 100. In addition to their different length, the connector stub 629 can also have different microstrip line widths.

Figure 7D:
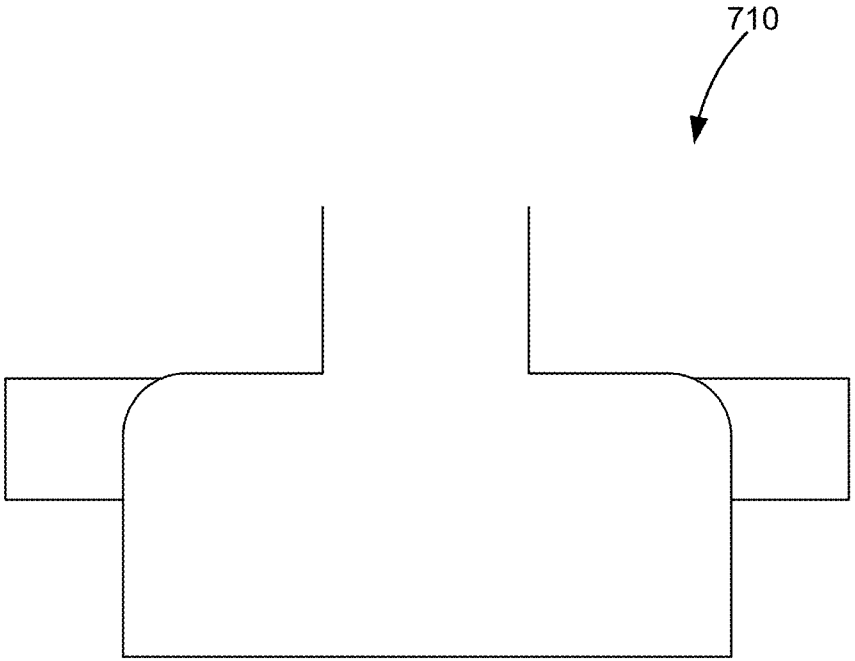
FIG. 7D depicts an enlarged top view of a radiation transmitter for the rectangular waveguide, in accordance with various embodiments of the present disclosure.

FIG. 7D depicts an enlarged top view of a transition 710 between rectangular waveguide 700 and microstrip lines connected to RF connectors 721, in accordance with at least one embodiment of the present disclosure. The waveguide 700 may be defined by a via fence 710. A metallic via block 712 may be provided in order to terminate the rectangular waveguide and to effectively capture the EM wave through transition 710. The slot in the transition 710 is located at about a quarter of the guided wavelength from the block 712.

The FSS 191, 292 as described herein may exhibit low insertion loss (i.e., <1.8 dB) in OFF-sate and high rejection (i.e., >14 dB up to 31 dB) in ON-state. The FSS 191, 292 may perform in a broad frequency range. Although the required frequency bandwidth is between about 27 GHz and about 29.5 GHz for millimeter wave range, FSS 191, 292 may operate between about 25 GHz and 32 GHz, as illustrated in FIG. 7B.

Referring again to FIGS. 1 and 2A, FSEs 600 are positioned radially on stack-up structure 110 and are arranged in FSE rows 115, where each FSE 600 is located radially at about equal distance from central port 105, 206.

The optimal number of FSE rows 115, 116 may be determined based on desired bandwidth of antenna 100, the bandwidth being determined as a frequency range of approximately constant gain. If one increases the radius of stack-up structure 110, the number of FSE rows 115, 116 may need to be increased. In some embodiments, the distance 117 between FSE rows 115, 116 may vary and may be shorter towards the center port 105, 206 and longer towards peripheral ports 151, 252.

In some embodiments, a distance 117 between FSE rows 115, 116 is approximately $2*\lambda_g$, where $\lambda_g$ is the wavelength of EM wave inside parallel-plate waveguides 131 and 132. This distance between FSE rows may be used for millimeter-wave applications.

Although it may be possible to have a quarter-wavelength distance 117 between FSS rows, such distance results in a large radiation beam width and low azimuth directivity. To obtain a high directivity while having the quarter-wavelength distance 117 between FSE rows 115 would require an unacceptably high number of FSEs 600.

In operation, antenna 100 may be steered by switching ON and OFF the switching elements 620 of FSE 600. The switching elements 620 are operated by controller 680. The EM wave 650 is transmitted when switching elements 620 are in OFF operation mode and reflected when the switching elements 620 are in ON operation mode.

Figure 8:
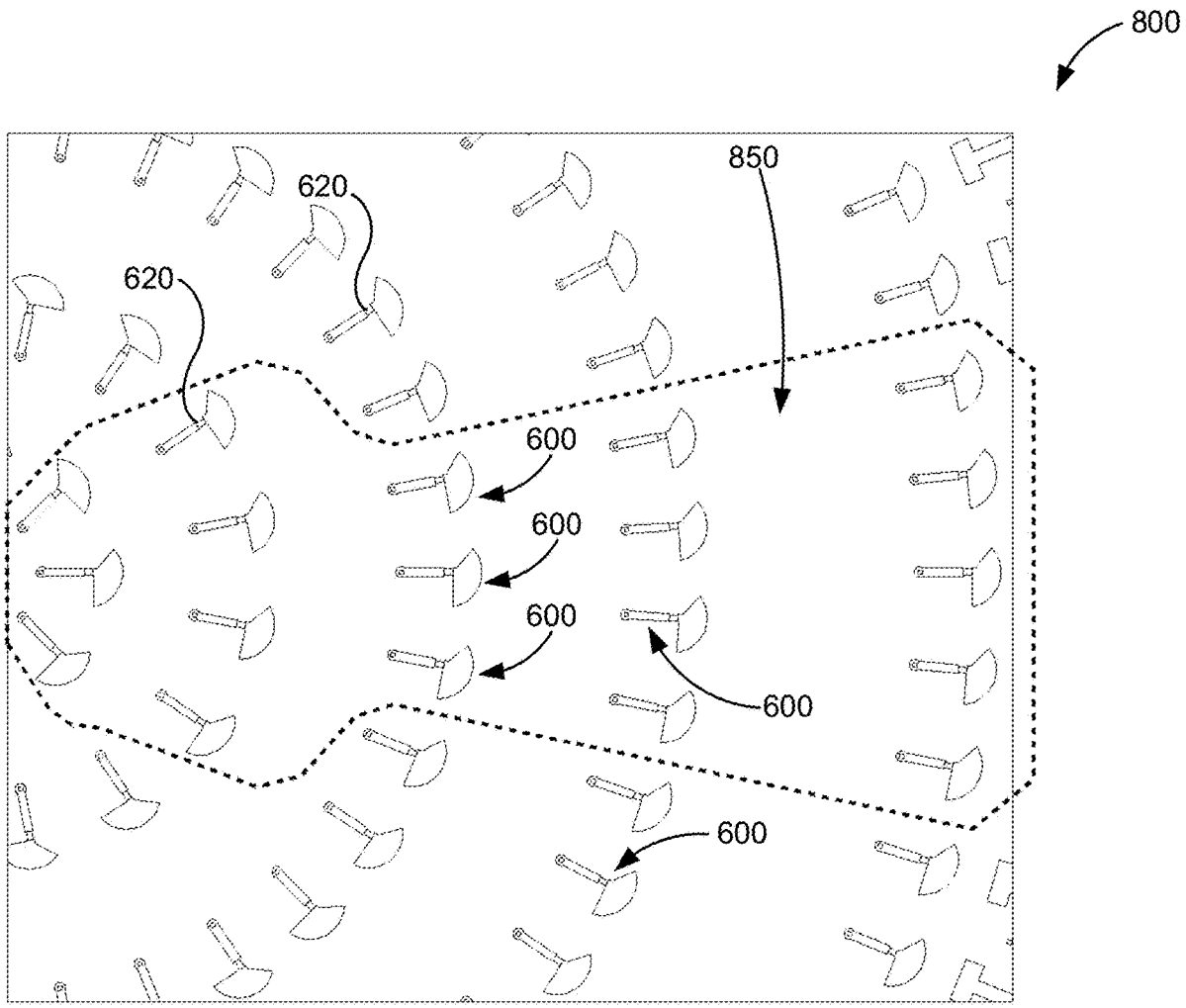
FIG. 8 illustrates a portion of the antenna of FIG. 1, in accordance with various embodiments of the present disclosure.

FIG. 8 illustrates a portion 800 of antenna 100, in accordance with various embodiments of the present disclosure. In some embodiments, FSEs 600 which are located inside an area 850 may be operated simultaneously and switch ON and OFF by controller 680 (not shown in FIG. 8). In accordance with embodiments discussed herein, controller 680 may determine the width of area 850 based on various parameters, such as, for example, a desired gain, a steering angle, and a desired beam width.

The switching elements 620 of FSEs 600, which are located inside area 850 are OFF, while switching elements 620 of FSEs 600 that are outside of area 850 are ON. The EM wave propagates inside area 850 and is absorbed by FSS outside of area 850.

Figure 9:
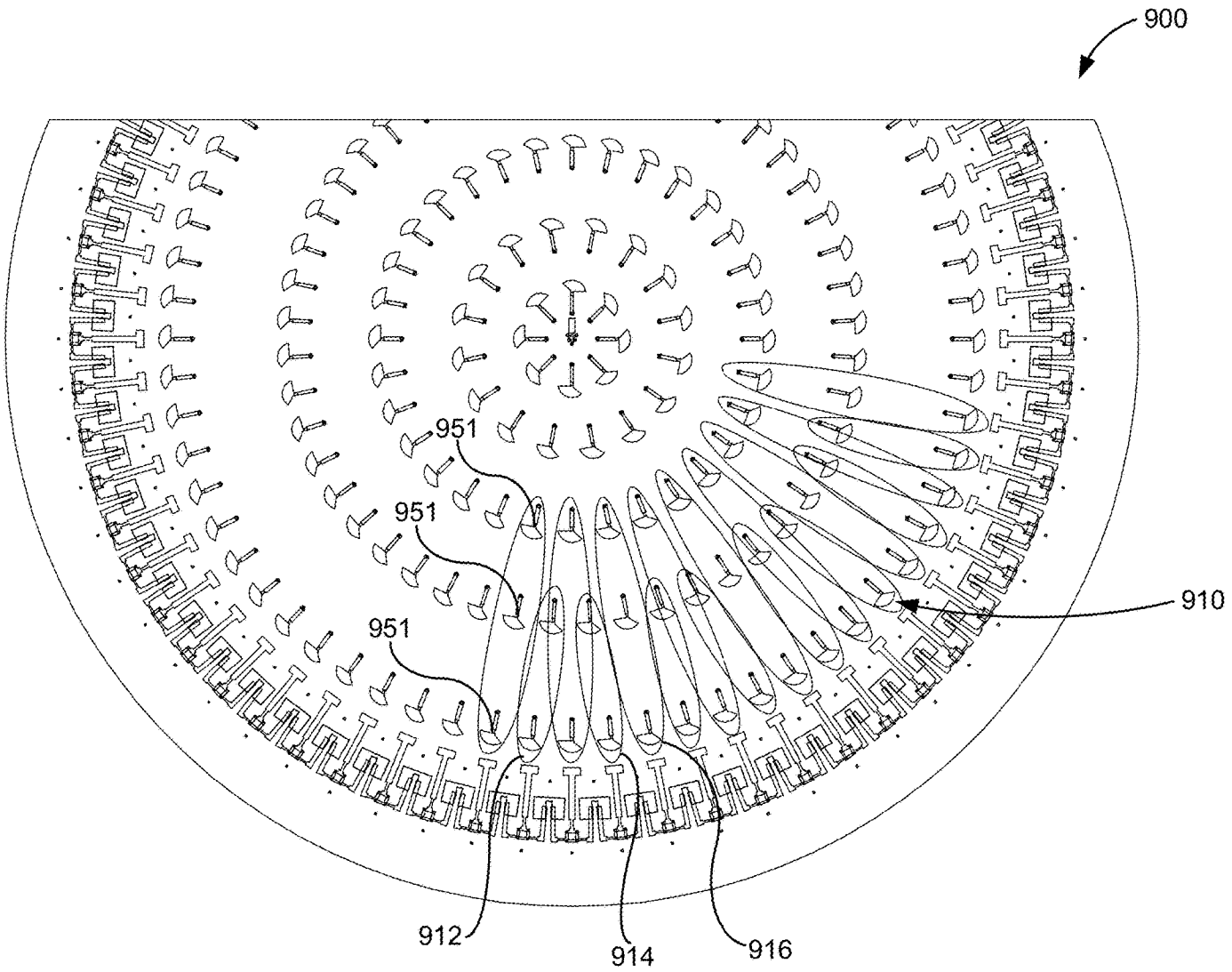
FIG. 9 illustrates a top view of another portion of the antenna of FIG. 1 where several FSEs are grouped together, in accordance with various embodiments of the present disclosure.

FIG. 9 illustrates a top view of another portion 900 of antenna 100 where several FSEs are grouped together in separate groups 910, such as, for example, groups 912, 914, 916, in accordance with at least one embodiment of the present disclosure. For example, three FSEs 951 may be operatively connected to the same DC circuit leading to a single DC controller. These interconnected FSE 951 may have the same voltage and/or current supplied to their switching elements. Grouping several FSEs in one feeding pack may help to simplify the operation of antenna 100 and reduce the number of pins in DC connector 181, 182.

Figure 10:
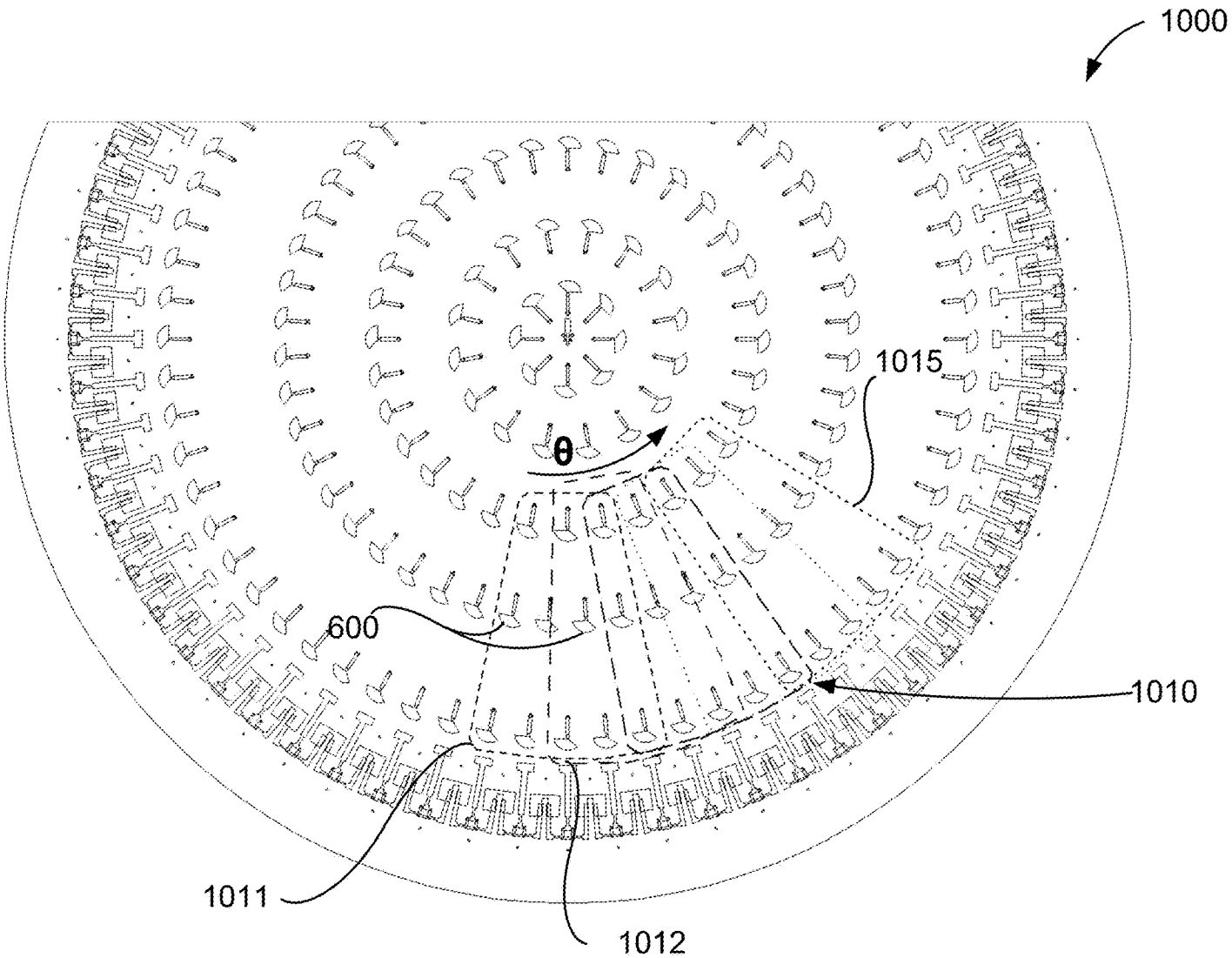
FIG. 10 illustrates beam steering of the antenna of FIG. 1, in accordance with various embodiments of the present disclosure.

FIG. 10 illustrates beam steering in a portion 1000 of antenna 100, in accordance with at least one embodiment of the present disclosure. The beam steering areas 1010 for various steering angles θ are defined by dashed lines. For example, at a first steering angle θ, FSEs 600 that are inside the area defined by line 1010 are in OFF operation mode. At the same time, all other FSEs 600, i.e. FSEs 600 that are outside of the area defined by dashed line 1010, are in ON operation mode.

To steer the beam of antenna 100, the controller may determine which FSE of the plurality of FSEs 600 needs to be switched on or off in order to obtain a desired beam width and gain. The controller may then switch OFF the FSEs 600 that are in the area defined by a dashed line 1012. The controller switched ON the other FSEs 600, which are outside of the area defined by dashed line 1012. Similarly, beam steering by other angles may be performed.

By selectively switching ON a first plurality of FSEs and switching OFF a second plurality of FSEs, antenna 100 may configure different horn shape waveguides for the propagation of the EM wave. Thus, antenna 100 provides reconfigurable waveguides, the width and direction of which may be modified by FSEs 600, and in particular by switchable elements 620.

The antenna 100 may be steered by different steering angles θ with a step of different angle values.

In at least one embodiment, antenna 100 may transmit EM wave to various directions simultaneously by switching OFF several FSS areas, therefore becoming a multi-directional antenna. For example, FSEs located in the areas defined by dashed lines 1011 and 1015 may be OFF simultaneously, providing transmission to (or reception from) different directions at the same time. It should be noted that, to simplify the drawings, the DC lines are not illustrated in FIGS. 8-10.

Figure 11A:
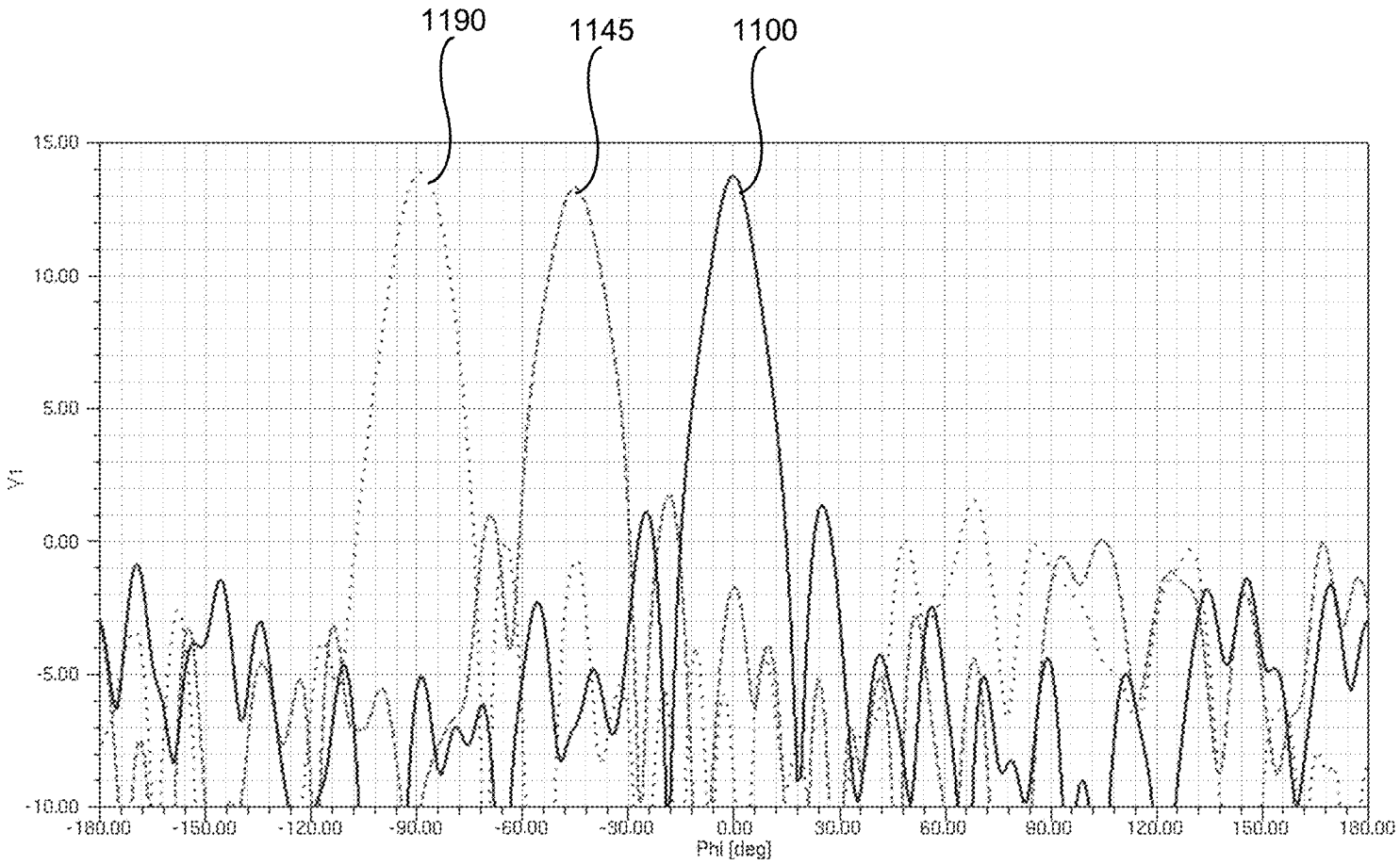
FIG. 11A depicts radiation patterns of the antenna of FIG. 1 for different beam-steering angles, in accordance with various embodiments of the present disclosure.
Figure 11B:
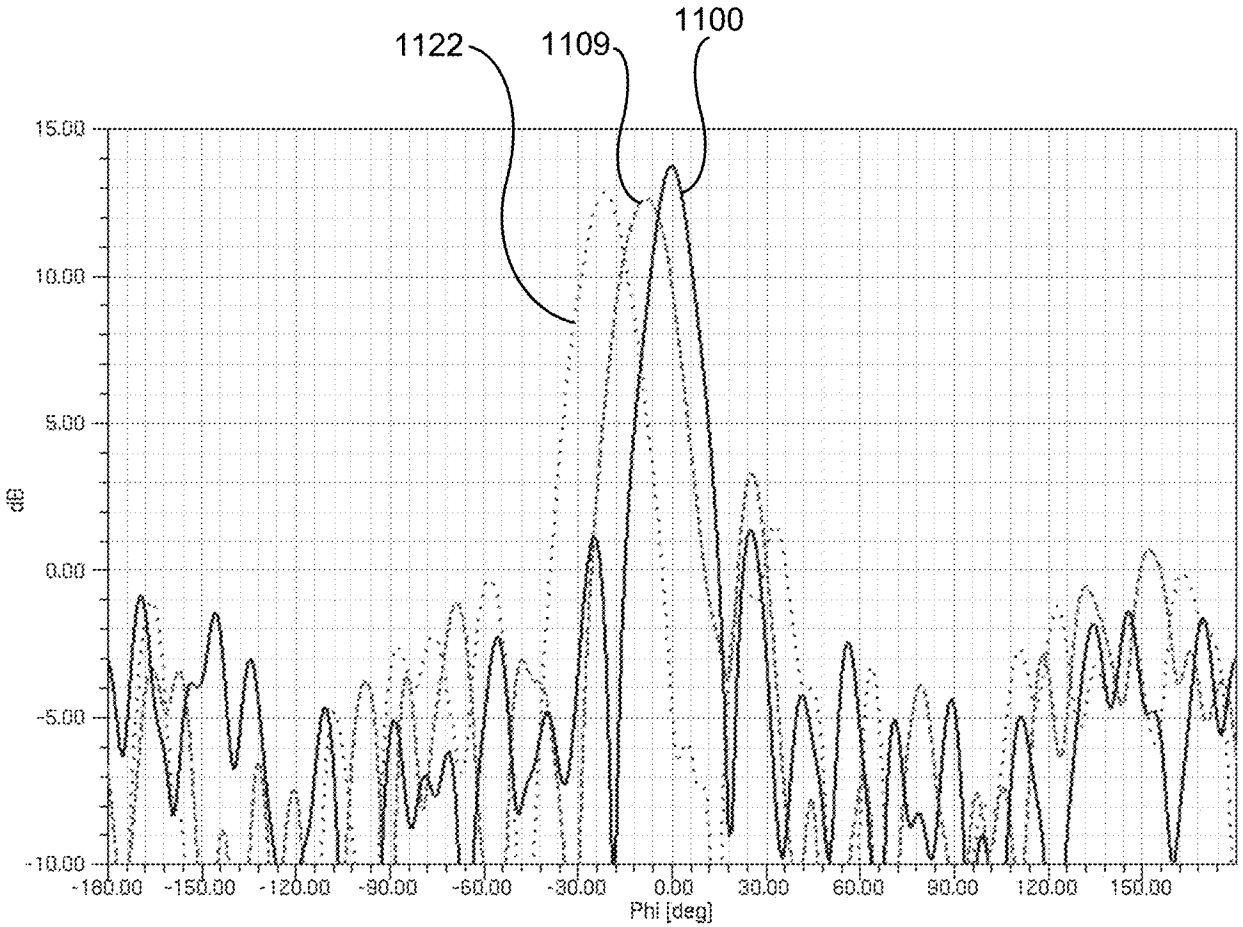
FIG. 11B depicts other radiation patterns of the antenna of FIG. 1 for beam-steering angles of 0, −9 degrees, and −22.5 degrees.
Figure 11C:
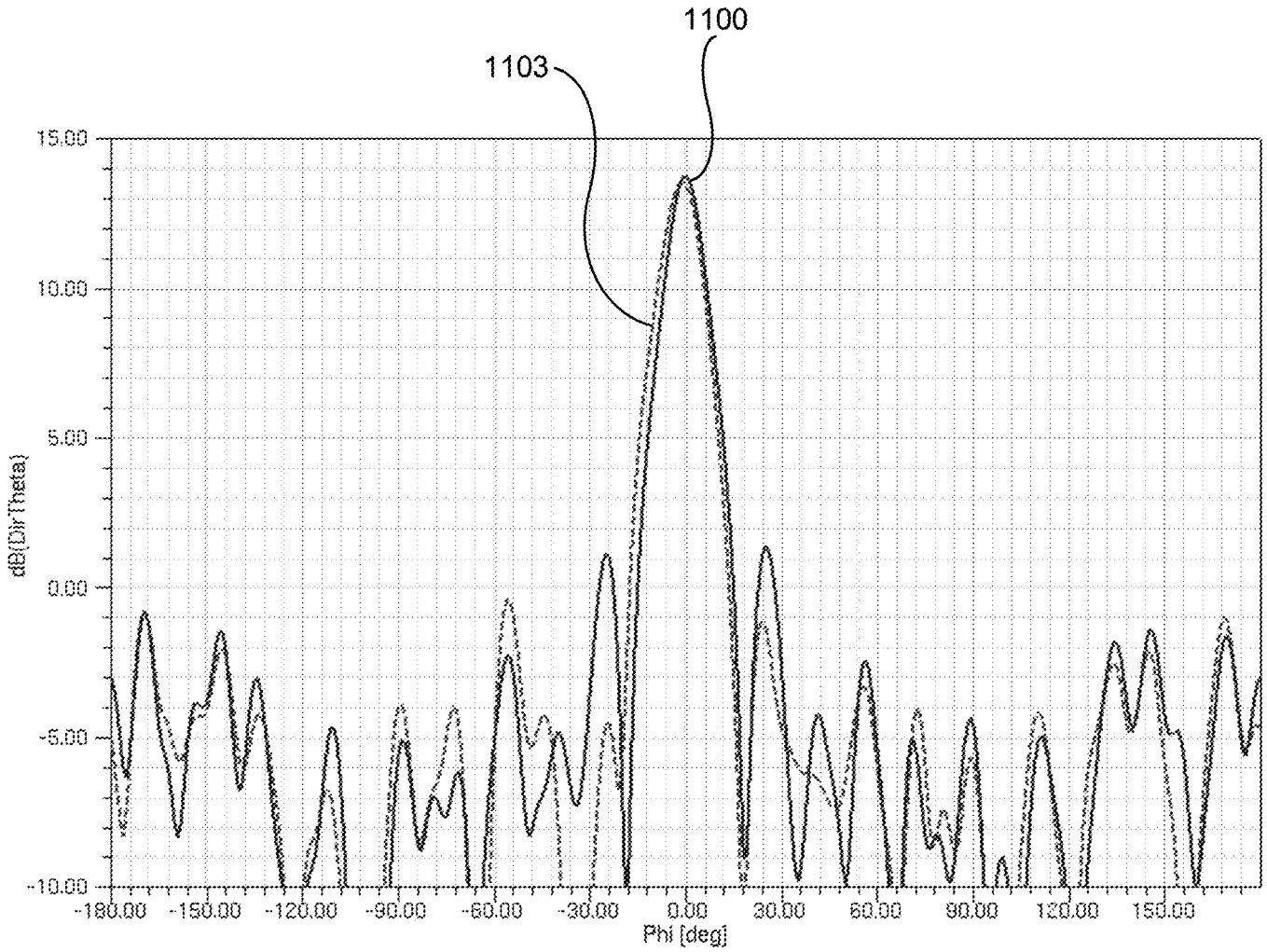
FIG. 11C depicts other radiation patterns of the antenna of FIG. 1 for beam-steering angles of 0 and −3 degrees.

FIG. 11A depicts radiation patterns of antenna 100 for different beam-steering angles, in accordance with various embodiments of the present disclosure. Line 1100 depicts radiation pattern for a beam steered by 0 degrees, line 1145—by 45 degrees and line 1190—by 90 degrees. FIG. 11B depicts other radiation patterns of antenna 100 for beam-steering angles of 0 (line 1100), −9 degrees (line 1109) and −22.5 degrees (line 1122). FIG. 11C depicts other radiation patterns of antenna 100 for beam-steering angles of 0 (line 1100) and −3 degrees (line 1103). It should be noted that all radiation patterns depicted in FIG. 11A-11C have high gain.

Various combinations of grouping and selective switching of FSEs 600 of antenna 100 may permit steering the beam with a beam-steering step of as low as 3 degrees.

Figure 12:
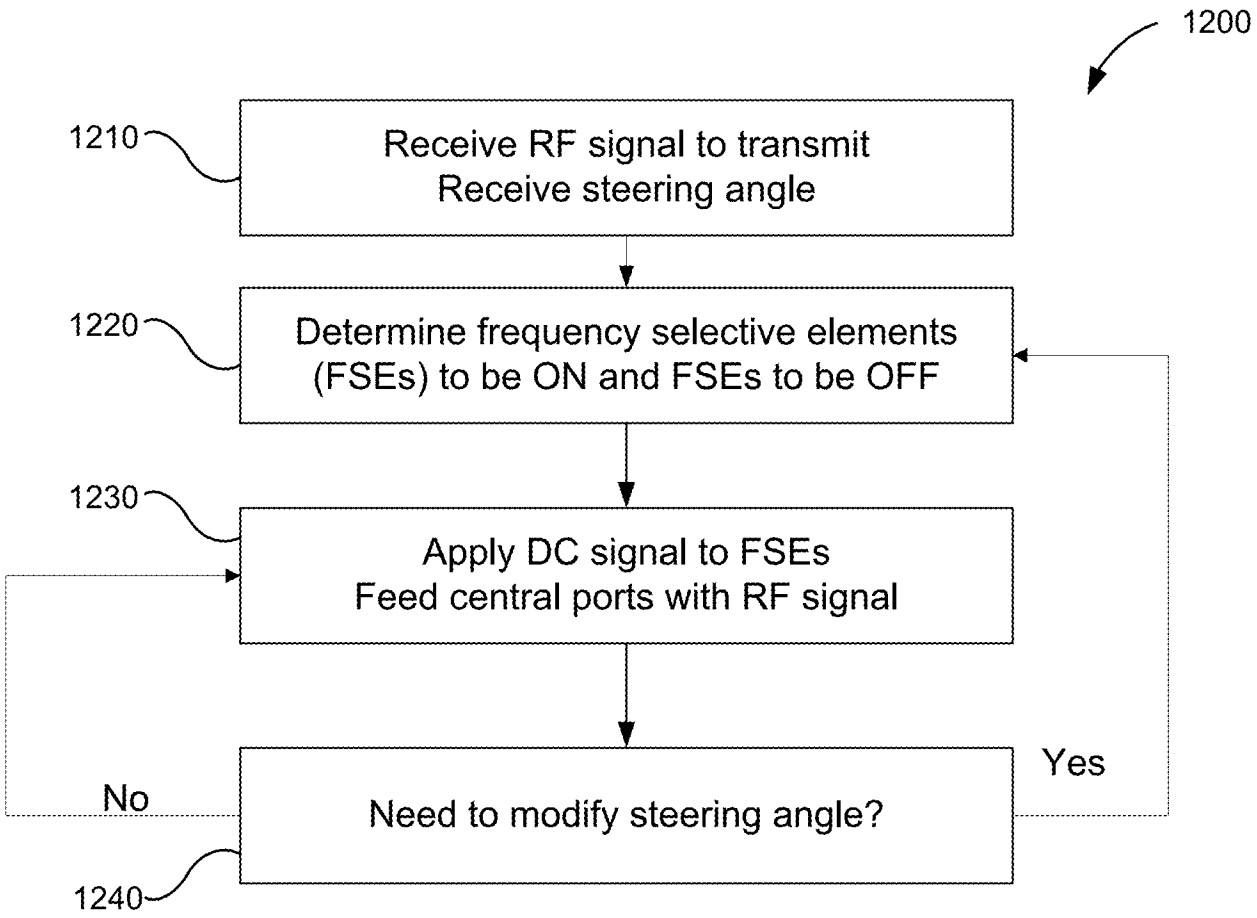
FIG. 12 illustrates a method of steering electromagnetic (EM) beam transmitted by the antenna of FIG. 1, in accordance with various embodiments of the present disclosure.

FIG. 12 illustrates a method 1200 of steering EM beam transmitted by antenna 100, in accordance with various embodiments of the present disclosure. At task block 1210, a controller (for example, an RF controller, or an RF controller combined with a DC controller) may receive an externally provided steering angle and RF signal for transmission by antenna 100. The controller then determines 1220 FSEs that need to be ON and FSEs that need to be OFF in order to transmit the RF signal at the provided steering angle. Polarization of radiated EM wave may also be determined by the controller at this task block 1210.

DC signal is then applied 1230 to FSEs of antenna 100 such that some FSEs are ON and the others are OFF, as determined previously by the controller. At the same time as the appropriate DC signal is applied to FSEs, RF signal is applied to one central port 105 or 206. As discussed above, the polarization of the transmitted EM wave may be controlled by supplying the RF signal to the central port, i.e. either to the central port located on first control circuit layer 101 or on second control circuit layer 202.

In order to modify 1240 the steering angle, the controller needs to determine 1220 again the appropriate number of FSEs that need to be OFF, as well as their location. The other FSEs may be turned ON by the controller. As discussed above, the polarization of radiated EM wave may be controlled by supplying RF signal to either one or another central port 105, 206.

When implemented using a PCB, antenna 100 may be integrated on one substrate, that is stack-up structure 110, using low-cost multilayer PCB manufacturing process. Several multilayer PCBs may be stacked together. This may aid in either or both of increasing diversity and improving the control of beam direction in elevation.

Figure 13:
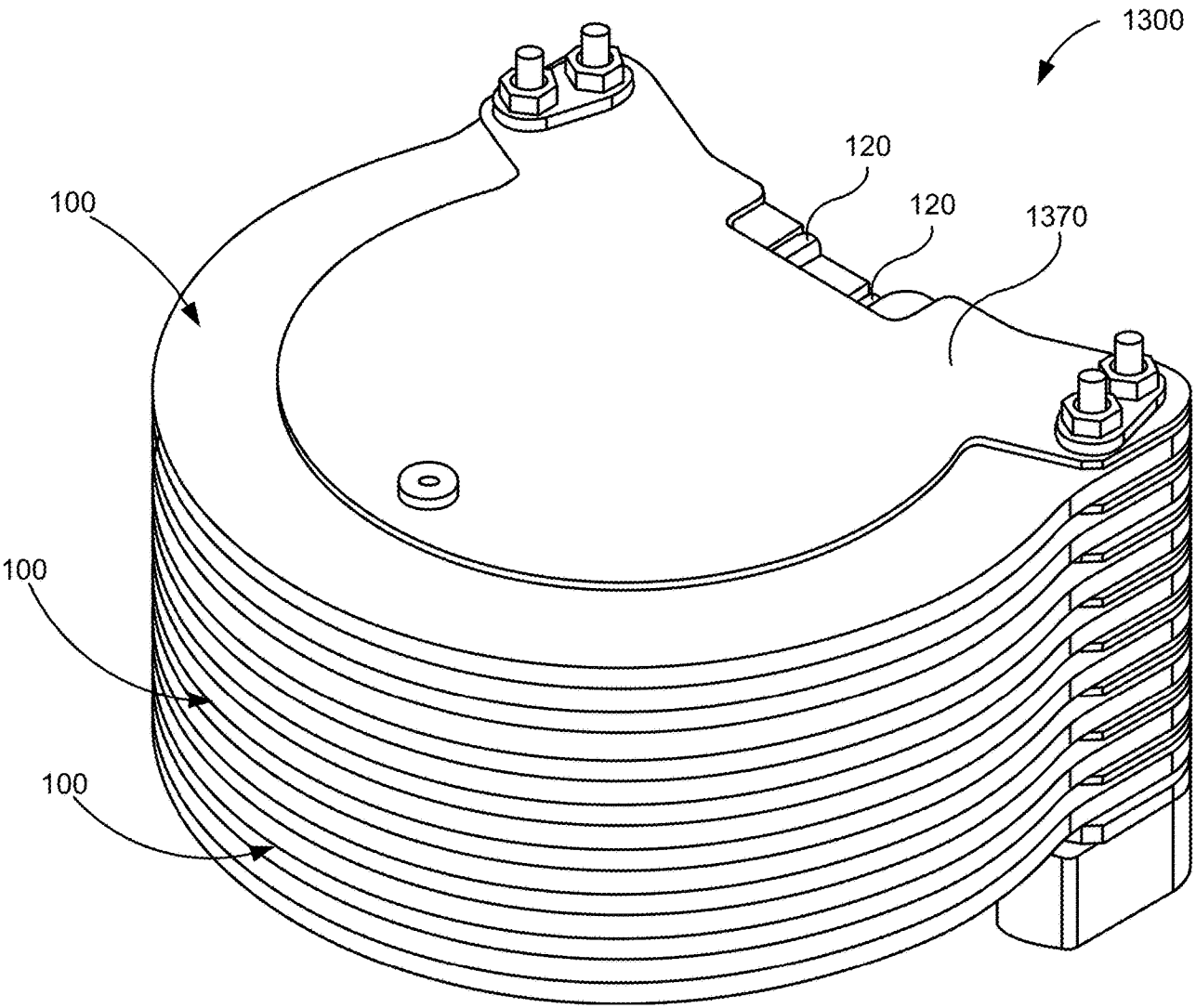
FIG. 13 depicts a stacked antenna, in accordance with various embodiments of the present disclosure.

FIG. 13 depicts a stacked antenna 1300, in accordance with various embodiments of the present disclosure. In stacked antenna 1300, several antennas 100 are stacked together. In particular, stacked antenna 1300 may be built when stack-up structure 110 of antennas 100 is made of PCB. Due to integration of the elements of antennas 100 with stack-up structure 110, such antenna 1300 may remain compact.

Protective layers 1370 may be provided between neighboring antennas 100 of stacked antenna 1300. The protective layers 1370 may help to reduce energy coupling between the FSSs (not depicted in FIG. 12) of the neighboring antennas 100. The protective layer 1370 may be made of a metal material, for example, aluminum. The RF connectors of antennas 100 may be operatively connected to a master controller (not shown) that is configured to operate the central ports (not depicted in FIG. 12) of antennas 100. DC connectors (not shown in FIG. 12) of antennas 100 may also be connected to the master controller, which may be configured to operate the FSS of antennas 100, and in particular, their switchable elements.

It is to be understood that the operations and functionality of at least some components of the disclosed antenna may be achieved by hardware-based, software-based, firmware-based elements and/or combinations thereof. Such operational alternatives do not, in any way, limit the scope of the present disclosure.

It will also be understood that, although the inventive concepts and principles presented herein have been described with reference to specific features, structures, and embodiments, it is clear that various modifications and combinations may be made without departing from the such disclosures. The specification and drawings are, accordingly, to be regarded simply as an illustration of the inventive concepts and principles as defined by the appended claims, and are contemplated to cover any and all modifications, variations, combinations or equivalents that fall within the scope of the present disclosure.

What is claimed is:

1. An antenna for transmission of a radio-frequency (RF) wave, the antenna comprising:

a stack-up structure having:

a first control layer;

a second control layer being approximately parallel to the first control layer;

a first parallel-plate waveguide and a second parallel-plate waveguide located between the first control layer and the second control layer, the first parallel-plate waveguide and the second parallel-plate waveguide being approximately parallel to each other and to the first control layer and the second control layer; and a plurality of through vias operatively connecting the first control layer and the second control layer to center RF and DC ground planes;

a first central port located on the first control layer and a second central port located on the second control layer, the first central port being configured to radiate the RF wave into the first parallel-plate waveguide, and the second central port being configured to radiate the RF wave into the second parallel-plate waveguide;

vertical-polarization peripheral ports integrated with the first control layer and configured to radiate the RF wave in vertical polarization from the first parallel-plate waveguide; and horizontal-polarization peripheral ports integrated with the second control layer and configured to radiate the RF wave in horizontal polarization from the second parallel-plate waveguide, each one of the vertical-polarization peripheral ports being collocated with one of the horizontal-polarization peripheral ports such that they cross each other.

2. The antenna of claim 1, wherein:

each one of the vertical-polarization peripheral ports comprises:

two inductance lines, located on the first control layer, and a monopole comprising:

four vias of the monopole operating as a radiating part of the monopole, a monopole microstrip operatively connecting the four vias of the monopole on the first control layer, and a block line operatively connecting two of the four vias of the monopole; and each one of the horizontal-polarization peripheral ports comprises:

a dipole having a first branch and a second branch, the dipole being located approximately perpendicular to the four vias of the monopole, a central portion of the dipole being located between the four vias of the monopole.

3. The antenna of claim 2, wherein a distance between the first control layer and the second control layer is configured to accommodate the monopole and is approximately a quarter wavelength in free space.

4. The antenna of claim 2, wherein the first branch and the second branch of the dipole are located in different planes.

5. The antenna of claim 1, further comprising:

a pair of frequency selective structures having frequency selective elements, each frequency selective structure being located partly on a corresponding one of the first control layer and second control layer, each frequency selective element being configured:

to allow propagation of the RF wave in one of the first parallel-plate waveguide and the second parallel-plate waveguide when the frequency selective element is in one operational mode and to forbid propagation of the RF wave in one of the first parallel-plate waveguide and the second parallel-plate waveguide when the frequency selective element is in another operational mode.

6. The antenna of claim 5, wherein each frequency selective element comprises:

a radial stub configured to choke high frequencies while passing low frequencies when the current received by the radial stub is higher than a threshold; and a switchable element operatively connected to the radial stub and one of the first parallel-plate waveguide and the second parallel-plate waveguide by one of the plurality of through vias, the switchable element configured to selectively control operational mode of the frequency selective element.

7. The antenna of claim 6, configured to steer a radiation angle of the RF wave by selectively switching between one and the other operational mode of the frequency selective elements and by selectively switching on a first plurality of frequency selective elements and switching off a second plurality of frequency selective elements.

8. The antenna of claim 6, wherein each switchable element further comprises a connector stub, the connector stub configured to operatively connect the switchable element to the one of the plurality of through vias, and the connector stub has a pair of stub arms each stub arm being operatively connected to the via and to the switchable element.

9. The antenna of claim 6, wherein the antenna is one of a plurality of antennas, and frequency selective elements of the plurality of antennas are configured to operate simultaneously and be selectively switched ON and OFF.

10. The antenna of claim 9, further configured to steer a radiation angle of the RF wave, the steering being provided by selectively switching on a first plurality of frequency selective elements of the plurality of antennas and switching off the second plurality of frequency selective elements of the plurality of antennas.

11. The antenna of claim 9, wherein the plurality of antennas comprises protective layers located between neighboring antennas.

12. The antenna of claim 5, wherein the frequency-selective elements of at least one frequency-selective structure of the pair of frequency-selective structures are arranged in rows, each frequency selective element in each row being located at approximately equal distance from the central port located on the same surface as the at least one frequency-selective structure of the pair of frequency selective structures.

13. The antenna of claim 12, wherein each switchable element further comprises a connector stub, the connector stub configured to operatively connect the switchable element to the one of the plurality of through vias, and and wherein at least one of rows of frequency selective elements has frequency selective elements with connector stubs being shorter than connector stubs of the other rows.

14. The antenna of claim 12, wherein the distance between the rows is approximately equal to $2*\lambda_g$, where $\lambda_g$ is the wavelength of the RF wave inside the corresponding one of the first parallel-plate waveguide and the second parallel-plate waveguide.

15. The antenna of claim 1, wherein at least two of the frequency selective elements are operatively connected to one direct current circuit and are operated simultaneously.

16. The antenna of claim 1, wherein at least one of the first central port and the second central port comprises:

a central microstrip operatively connected to one central via traversing the corresponding one of the first parallel-plate waveguide and the second parallel-plate waveguide, the central via being connected to an electrical ground;

a pair of shoulders, both shoulders being operatively connected to a feed, the feed being operatively connected to an RF controller and being configured to deliver RF energy to the pair of shoulders; and a plurality of sub-shoulders, each sub-shoulder being operatively connected to one of the pair of shoulders on one end and to the central microstrip on the other end, a distance between two neighboring sub-shoulders of the plurality of sub-shoulders at their respective connection points with the central microstrip being approximately the same for each pair of neighboring sub-shoulders of the plurality of sub-shoulders.

* * * * *